US010533764B2

(12) United States Patent
Yamada et al.

(10) Patent No.: US 10,533,764 B2
(45) Date of Patent: Jan. 14, 2020

(54) AIR CONDITIONER

(71) Applicant: DAIKIN INDUSTRIES, LTD., Osaka-shi, Osaka (JP)

(72) Inventors: Takuro Yamada, Osaka (JP); Yuusuke Nakagawa, Osaka (JP); Yuusuke Oka, Osaka (JP)

(73) Assignee: DAIKIN INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 16/385,819

(22) Filed: Apr. 16, 2019

(65) Prior Publication Data

US 2019/0242602 A1 Aug. 8, 2019

Related U.S. Application Data

(63) Continuation of application No. PCT/JP2017/038154, filed on Oct. 23, 2017.

(30) Foreign Application Priority Data

Oct. 28, 2016 (JP) ..... 2016-211676

(51) Int. Cl.

| | |
|---|---|
| ***F24F 11/02*** | (2006.01) |
| ***F24F 11/36*** | (2018.01) |
| ***F25B 49/02*** | (2006.01) |
| ***F24F 11/89*** | (2018.01) |
| ***F24F 11/84*** | (2018.01) |
| ***F25B 13/00*** | (2006.01) |
| ***F25B 41/04*** | (2006.01) |

(Continued)

(52) U.S. Cl.

CPC ..... *F24F 11/36* (2018.01); *F24F 11/46* (2018.01); *F24F 11/49* (2018.01); *F24F 11/84* (2018.01); *F24F 11/88* (2018.01); *F24F 11/89* (2018.01); *F25B 13/00* (2013.01); *F25B 41/04* (2013.01); *F25B 49/02* (2013.01); *F25B 2500/222* (2013.01); *F25B 2600/2519* (2013.01)

(58) Field of Classification Search

CPC .. F24F 11/32; F24F 11/36; F24F 11/49; F24F 11/84; F24F 11/89; F25B 13/00; F25B 2313/023; F25B 2313/0233; F25B 2500/22; F25B 2500/222; F25B 2600/25; F25B 2600/2519

See application file for complete search history.

(56) References Cited

U.S. PATENT DOCUMENTS

2013/0014525 A1 1/2013 Koge et al.
2014/0033754 A1* 2/2014 Hatomura ..... F25B 13/00 62/190

FOREIGN PATENT DOCUMENTS

EP 2492614 A1 8/2012
JP 2009-299910 A 12/2009

(Continued)

OTHER PUBLICATIONS

International Search Report (PCT/ISA/210) issued in PCT/JP2017/038154, dated Dec. 26, 2017.

*Primary Examiner* — Jonathan Bradford
(74) *Attorney, Agent, or Firm* — Birch, Stewart, Kolasch & Birch, LLP

(57) ABSTRACT

When refrigerant leakage occurs, a controller in an air conditioner performs first shutoff control to open a liquid relay shutoff valve and close an indoor expansion valve and a gas relay shutoff valve on the basis of information from a refrigerant leakage detector.

8 Claims, 7 Drawing Sheets

(51) Int. Cl.

| | |
|---|---|
| ***F24F 11/46*** | (2018.01) |
| ***F24F 11/88*** | (2018.01) |
| ***F24F 11/49*** | (2018.01) |

(56) References Cited

FOREIGN PATENT DOCUMENTS

| | | | |
|---|---|---|---|
| JP | 2012-013339 | A | 1/2012 |
| JP | 5517789 | B | 6/2014 |
| JP | 2016-11780 | A | 1/2016 |
| WO | WO 2011/141959 | A1 | 11/2011 |

* cited by examiner

AIR CONDITIONER

CROSS REFERENCE TO RELATED APPLICATIONS

This application is a Continuation of PCT International Application No. PCT/JP2017/038154, filed on Oct. 23, 2017, which claims priority under 35 U.S.C. 119(a) to Patent Application No. 2016-211676, filed in Japan on Oct. 28, 2016, all of which are hereby expressly incorporated by reference into the present application.

TECHNICAL FIELD

The present invention relates to air conditioners, and more specifically to an air conditioner including an outdoor unit, a plurality of indoor units, a liquid-refrigerant connection pipe, a gas-refrigerant connection pipe, a relay unit including a relay shutoff valve in a liquid connection pipe connected to the liquid-refrigerant connection pipe and a relay shutoff valve in a gas connection pipe connected to the gas-refrigerant connection pipe, and refrigerant leakage detector for detecting leakage of refrigerant.

BACKGROUND ART

Conventionally, an air conditioner includes an outdoor unit including a compressor, a plurality of indoor units, each including an indoor expansion valve and an indoor heat exchanger, a liquid-refrigerant connection pipe and a gas-refrigerant connection pipe that connect the outdoor unit and the indoor units to each other, and at least one relay unit disposed in the liquid-refrigerant connection pipe and the gas-refrigerant connection pipe and configured to individually switch the plurality of indoor heat exchangers so that each of the plurality of indoor heat exchangers functions as a refrigerant evaporator or a refrigerant radiator. Such an air conditioner is described in PTL 1 (Japanese Patent No. 5517789), in which a liquid connection pipe (a refrigerant pipe connected to the liquid-refrigerant connection pipe) and a gas connection pipe (a refrigerant pipe connected to the gas-refrigerant connection pipe) in the relay unit are each provided with a relay shutoff valve (a liquid relay shutoff valve and a gas relay shutoff valve) such that when refrigerant leakage occurs, the liquid relay shutoff valve and the gas relay shutoff valve are closed to prevent the flow of refrigerant into an indoor unit from the outdoor unit to suppress leakage of refrigerant from the indoor unit.

SUMMARY OF THE INVENTION

In the configuration in PTL 1, when refrigerant leakage occurs, the liquid relay shutoff valve and the gas relay shutoff valve in the relay unit are closed to separate a portion between the liquid relay shutoff valve and the gas relay shutoff valve including the indoor unit. Accordingly, the refrigerant leaking portion is limited to a portion between the liquid relay shutoff valve and the gas relay shutoff valve including the indoor unit.

However, closing the liquid relay shutoff valve and the gas relay shutoff valve in the relay unit means permitting leakage of refrigerant that exists in the portion between the liquid relay shutoff valve and the gas relay shutoff valve including the indoor unit, and may not be sufficient in terms of reduction in the amount of leakage.

An object of the present invention is to provide an air conditioner including an outdoor unit, a plurality of indoor units, a liquid-refrigerant connection pipe, a gas-refrigerant connection pipe, a relay unit including a relay shutoff valve in a liquid connection pipe connected to the liquid-refrigerant connection pipe and a relay shutoff valve in a gas connection pipe connected to the gas-refrigerant connection pipe, and refrigerant leakage detector for detecting leakage of refrigerant, in which when refrigerant leakage occurs, the amount of leakage of refrigerant is reduced.

An air conditioner according to a first aspect includes an outdoor unit, a plurality of indoor units, a liquid-refrigerant connection pipe, a gas-refrigerant connection pipe, at least one relay unit, refrigerant leakage detector, and a controller. The outdoor unit includes a compressor. Each of the indoor units includes an indoor expansion valve and an indoor heat exchanger. The liquid-refrigerant connection pipe and the gas-refrigerant connection pipe connect the outdoor unit and the indoor units to each other. The relay unit is disposed in the liquid-refrigerant connection pipe and the gas-refrigerant connection pipe. The relay unit includes a liquid relay shutoff valve in a liquid connection pipe connected to the liquid-refrigerant connection pipe, and a gas relay shutoff valve in a gas connection pipe connected to the gas-refrigerant connection pipe, and is configured to individually switch the plurality of indoor heat exchangers so that each of the plurality of indoor heat exchangers functions as an evaporator for refrigerant or a radiator for the refrigerant. The refrigerant leakage detector detects leakage of the refrigerant. The controller controls components of the outdoor unit, the indoor units, and the relay unit. When leakage of the refrigerant occurs, the controller performs first shutoff control to open the liquid relay shutoff valve and close at least one of the indoor expansion valves and the gas relay shutoff valve on the basis of information from the refrigerant leakage detector.

As described above, when refrigerant leakage occurs, first shutoff control is performed to close an indoor expansion valve and a gas relay shutoff valve with a liquid relay shutoff valve open, thereby separating only a portion between the indoor expansion valve and the gas relay shutoff valve including an indoor heat exchanger from which refrigerant is likely to leak. Accordingly, the refrigerant leaking portion is limited to a portion between the indoor expansion valve and the gas relay shutoff valve including the indoor heat exchanger. This means that closing the liquid relay shutoff valve and the gas relay shutoff valve in the relay unit when refrigerant leakage occurs can make the refrigerant leaking portion narrower than that in a case where a portion between the liquid relay shutoff valve and the gas relay shutoff valve including an indoor unit is separated, where allowing the refrigerant leaking portion to include an indoor heat exchanger from which refrigerant is likely to leak.

In this way, when refrigerant leakage occurs, first shutoff control is performed, thereby enabling separation of only a narrow portion between an indoor expansion valve and a gas relay shutoff valve including an indoor heat exchanger from which refrigerant is likely to leak. The amount of leakage of refrigerant can thus be reduced.

An air conditioner according to a second aspect is the air conditioner according to the first aspect, in which the liquid relay shutoff valve is an electric expansion valve, and the controller slightly opens the liquid relay shutoff valve in the first shutoff control. As used here, the term "slightly opening" refers to opening the liquid relay shutoff valve at an opening degree of about 15% or less when fully opening of the liquid relay shutoff valve is represented as 100%.

Refrigerant leakage may also occur from a portion between a liquid relay shutoff valve and an indoor expansion valve, which is less likely to occur than refrigerant leakage from around an indoor heat exchanger (a portion between the indoor expansion valve and the gas relay shutoff valve including the indoor heat exchanger). It is thus preferable to expect that, when only the portion between the indoor expansion valve and the gas relay shutoff valve including the indoor heat exchanger is separated through the first shutoff control, refrigerant leakage may also occur from a portion between the liquid relay shutoff valve and the indoor expansion valve. It is also preferable to reduce the flow of refrigerant into the portion between the liquid relay shutoff valve and the indoor expansion valve from the outdoor unit side.

Thus, as described above, the liquid relay shutoff valve, which is constituted by an electric expansion valve, is slightly opened in the first shutoff control to reduce the flow of refrigerant into the portion between the liquid relay shutoff valve and the indoor expansion valve from the outdoor unit side.

Accordingly, even if leakage of refrigerant has occurred from a portion between a liquid relay shutoff valve and an indoor expansion valve, the leakage of refrigerant from this portion can be minimized during the first shutoff control.

An air conditioner according to a third aspect is the air conditioner according to the first or second aspect, in which when it is determined that the leakage of the refrigerant continues even after the first shutoff control is performed, the controller performs second shutoff control to close the liquid relay shutoff valve with the at least one of the indoor expansion valves closed.

If the leakage of refrigerant continues even after the portion between the indoor expansion valve and the gas relay shutoff valve including the indoor heat exchanger is separated through the first shutoff control, leakage of refrigerant may have occurred from the portion between the liquid relay shutoff valve and the indoor expansion valve.

Thus, as described above, if it is determined that the leakage of refrigerant continues even after the first shutoff control is performed, second shutoff control is performed to close the liquid relay shutoff valve with the indoor expansion valve closed, thereby separating the portion between the liquid relay shutoff valve and the indoor expansion valve.

Accordingly, when refrigerant leakage occurs, the first shutoff control is followed by the second shutoff control, thereby separating a portion between a liquid relay shutoff valve and an indoor expansion valve. The amount of leakage of refrigerant can thus be reduced.

An air conditioner according to a fourth aspect is the air conditioner according to the third aspect, in which each of the indoor units further includes a temperature sensor that detects a temperature of the refrigerant around the indoor heat exchanger, and the controller determines whether the leakage of the refrigerant continues even after the first shutoff control is performed, on the basis of the temperatures of the refrigerant detected by the temperature sensors during the first shutoff control.

If refrigerant leakage occurs around an indoor heat exchanger (a portion between an indoor expansion valve and a gas relay shutoff valve including an indoor heat exchanger), the temperature of refrigerant around the indoor heat exchanger tends to rapidly change due to refrigerant leakage when the first shutoff control is performed, compared to the case where no refrigerant leakage occurs around the indoor heat exchanger, or the temperature of refrigerant around the indoor heat exchanger may become quickly close to the ambient temperature (such as the indoor temperature) of the indoor heat exchanger is placed. For example, if the change rate of the temperature of refrigerant around the indoor heat exchanger is larger than a predetermined change rate or if the temperature of refrigerant around the indoor heat exchanger reaches a predetermined temperature, which is determined by the ambient temperature, within a predetermined time period, it can be determined that refrigerant leakage has occurred around the indoor heat exchanger. If the change rate of the temperature of refrigerant around the indoor heat exchanger is less than or equal to the predetermined change rate or if the temperature of refrigerant around the indoor heat exchanger does not reach the predetermined temperature, which is determined by the ambient temperature, within the predetermined time period, it can be determined that no refrigerant leakage has occurred around the indoor heat exchanger, that is, that the leakage of refrigerant continues even after the first shutoff control is performed.

Accordingly, whether the leakage of refrigerant continues even after the first shutoff control is performed can be suitably determined.

An air conditioner according to a fifth aspect is the air conditioner according to the third or fourth aspect, in which the controller opens the gas relay shutoff valve in the second shutoff control.

If it is determined that the leakage of refrigerant continues even after the first shutoff control is performed, it is likely that no refrigerant leakage has occurred around the indoor heat exchanger (the portion between the indoor expansion valve and the gas relay shutoff valve including the indoor heat exchanger).

Thus, as described above, the gas relay shutoff valve is opened in the second shutoff control.

Accordingly, the separation of the portion between the indoor expansion valve and the gas relay shutoff valve can be canceled, and only the portion between the liquid relay shutoff valve and the indoor expansion valve can be separated.

An air conditioner according to a sixth aspect is the air conditioner according to the fifth aspect, in which the gas relay shutoff valve is an electric expansion valve, and the controller slightly opens the gas relay shutoff valve in the second shutoff control. As used here, the term "slightly opening" refers to opening the gas relay shutoff valve at an opening degree of about 15% or less when fully opening of the gas relay shutoff valve is represented as 100%.

Even if it is determined that the leakage of refrigerant continues even after the first shutoff control is performed, it is difficult to completely deny the probability of occurrence of leakage of refrigerant around the indoor heat exchanger (the portion between the indoor expansion valve and the gas relay shutoff valve including the indoor heat exchanger). It is thus preferable to expect that, when only the portion between the liquid relay shutoff valve and the indoor expansion valve is separated through the second shutoff control, refrigerant leakage may also occur from the portion between the indoor expansion valve and the gas relay shutoff valve. It is also preferable to reduce the flow of refrigerant into a portion between the gas relay shutoff valve and the indoor expansion valve from the outdoor unit side.

Thus, as described above, the gas relay shutoff valve, which is constituted by an electric expansion valve, is slightly opened in the second shutoff control to reduce the flow of refrigerant into the portion between the gas relay shutoff valve and the indoor expansion valve from the outdoor unit side.

Accordingly, even if leakage of refrigerant has occurred from a portion between an indoor expansion valve and a gas relay shutoff valve, the leakage of refrigerant from this portion can be minimized during the second shutoff control.

DESCRIPTION OF EMBODIMENTS

Figure 1:
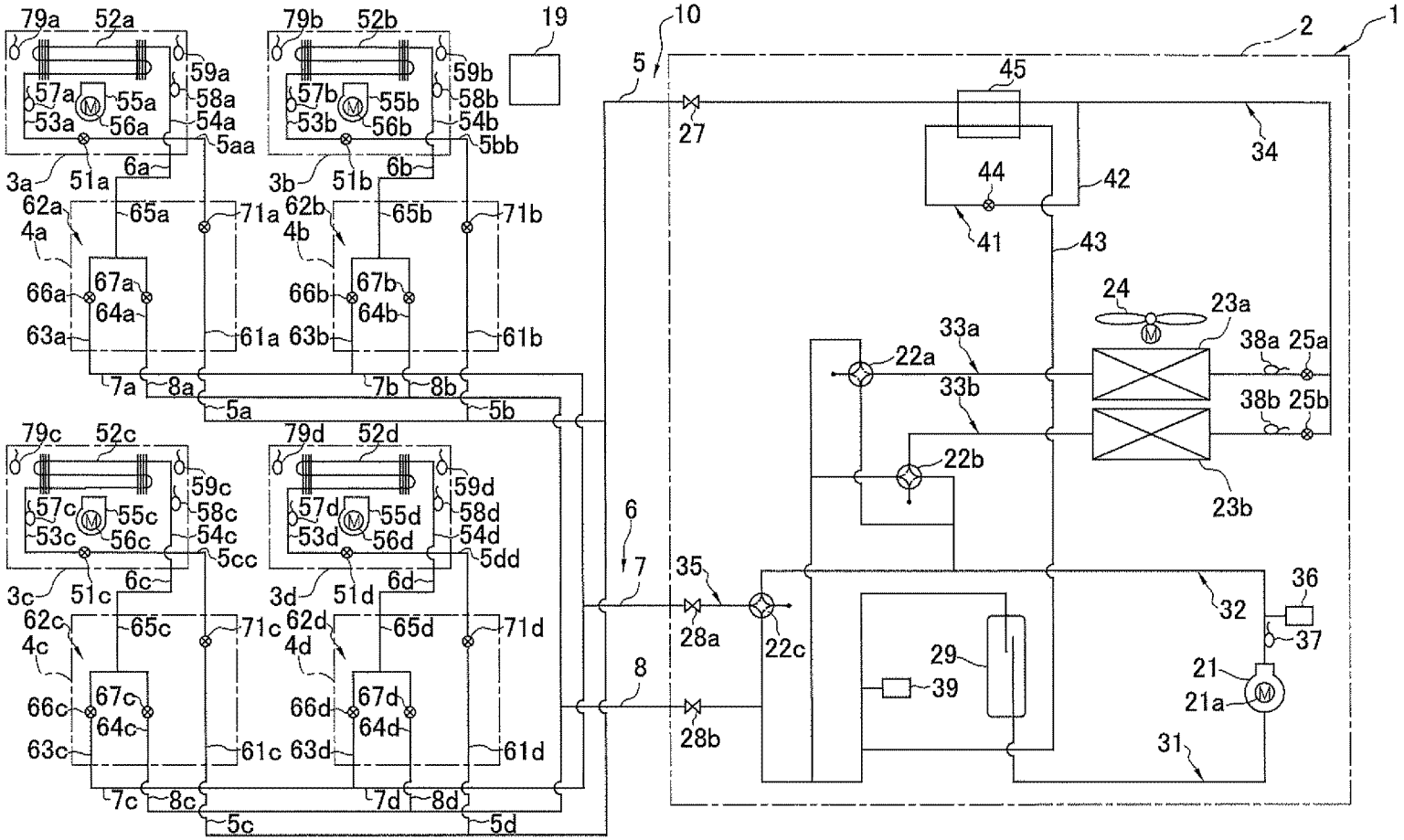
FIG. 1 is a schematic configuration diagram of an air conditioner according to an embodiment of the present invention.

The following describes an air conditioner according to an embodiment of the present invention with reference to the drawings. Specific configurations of an air conditioner according to an embodiment of the present invention are not limited to those in the following embodiment and its modifications, and may be changed without departing from the gist of the invention.

(1) Configuration

The configuration of an air conditioner 1 will be described with reference to FIG. 1. The air conditioner 1 is a device that performs cooling and heating of indoor spaces, such as in a building, through a vapor compression refrigeration cycle. The air conditioner 1 mainly includes an outdoor unit 2, a plurality of (here, four) indoor units 3*a*, 3*b*, 3*c*, and 3*d*, which are connected in parallel to each other, relay units 4*a*, 4*b*, 4*c*, and 4*d*, which are respectively connected to the indoor units 3*a*, 3*b*, 3*c*, and 3*d*, connection pipes 5 and 6, which connect the outdoor unit 2 and the indoor units 3*a*, 3*b*, 3*c*, and 3*d* to each other via the relay units 4*a*, 4*b*, 4*c*, and 4*d*, and a controller 19, which controls the components of the outdoor unit 2, the indoor units 3*a*, 3*b*, 3*c*, and 3*d*, and the relay units 4*a*, 4*b*, 4*c*, and 4*d*. The outdoor unit 2, the indoor units 3*a*, 3*b*, 3*c*, and 3*d*, the relay units 4*a*, 4*b*, 4*c*, and 4*d*, and the connection pipes 5 and 6 are connected to each other, thereby forming a vapor compression refrigerant circuit 10 of the air conditioner 1. The refrigerant circuit 10 is filled with a refrigerant such as R32. The air conditioner 1 is configured such that the indoor units 3*a*, 3*b*, 3*c*, and 3*d* are capable of individually performing cooling operation or heating operation through the relay units 4*a*, 4*b*, 4*c*, and 4*d* and delivery of refrigerant from an indoor unit that performs heating operation to an indoor unit that performs cooling operation enables heat recovery between the indoor units (here, simultaneous cooling and heating operation for simultaneously performing cooling operation and heating operation).

<Refrigerant Connection Pipes>

The liquid-refrigerant connection pipe 5 mainly includes a junction pipe portion that extends from the outdoor unit 2, a plurality of (here, four) first branch pipe portions 5*a*, 5*b*, 5*c*, and 5*d*, which branch off from the liquid-refrigerant connection pipe 5 before reaching the relay units 4*a*, 4*b*, 4*c*, and 4*d*, and second branch pipe portions 5*aa*, 5*bb*, 5*cc*, and 5*dd*, which connect the relay units 4*a*, 4*b*, 4*c*, and 4*d* and the indoor units 3*a*, 3*b*, 3*c*, and 3*d* to each other. The gas-refrigerant connection pipe 6 mainly includes a high/low-pressure gas-refrigerant connection pipe 7, a low-pressure gas-refrigerant connection pipe 8, and branch pipe portions 6*a*, 6*b*, 6*c*, and 6*d*, which connect the relay units 4*a*, 4*b*, 4*c*, and 4*d* and the indoor units 3*a*, 3*b*, 3*c*, and 3*d* to each other. The high/low-pressure gas-refrigerant connection pipe 7 is a gas-refrigerant connection pipe from which the connection to the discharge side or suction side of a compressor 21 (described below) is switchable. The high/low-pressure gas-refrigerant connection pipe 7 includes a junction pipe portion that extends from the outdoor unit 2, and a plurality of (here, four) branch pipe portions 7*a*, 7*b*, 7*c*, and 7*d*, which branch off from the high/low-pressure gas-refrigerant connection pipe 7 before reaching the relay units 4*a*, 4*b*, 4*c*, and 4*d*. The low-pressure gas-refrigerant connection pipe 8 is a gas-refrigerant connection pipe connected to the suction side of the compressor 21 (described below). The low-pressure gas-refrigerant connection pipe 8 includes a junction pipe portion that extends from the outdoor unit 2, and a plurality of (here, four) branch pipe portions 8*a*, 8*b*, 8*c*, and 8*d*, which branch off from the low-pressure gas-refrigerant connection pipe 8 before reaching the relay units 4*a*, 4*b*, 4*c*, and 4*d*. Since the gas-refrigerant connection pipe 6 includes the high/low-pressure gas-refrigerant connection pipe 7 and the low-pressure gas-refrigerant connection pipe 8, a configuration having three connection pipes including the liquid-refrigerant connection pipe 5 (a so-called three-pipe configuration) is achieved.

<Indoor Unit>

The indoor units 3*a*, 3*b*, 3*c*, and 3*d* are installed in indoor spaces, such as in a building. As described above, the indoor units 3*a*, 3*b*, 3*c*, and 3*d* are connected to the outdoor unit 2 via the liquid-refrigerant connection pipe 5, the gas-refrigerant connection pipe 6 (the high/low-pressure gas-refrigerant connection pipe 7, the low-pressure gas-refrigerant connection pipe 8, and the branch pipe portions 6*a*, 6*b*, 6*c*, and 6*d*), and the relay units 4*a*, 4*b*, 4*c*, and 4*d*. The indoor units 3*a*, 3*b*, 3*c*, and 3*d* form part of the refrigerant circuit 10.

Next, the configuration of the indoor units 3*a*, 3*b*, 3*c*, and 3*d* will be described. Since the configuration of the indoor unit 3*a* is similar to the configurations of the indoor units 3*b*, 3*c*, and 3*d*, only the configuration of the indoor unit 3*a* will be described. The configurations of the indoor units 3*b*, 3*c*, and 3*d* are respectively denoted by numbers with suffixes "b", "c", and "d", instead of the suffix "a", which is used to indicate the elements of the indoor unit 3*a*, and the elements of the indoor units 3*b*, 3*c*, and 3*d* will not be described.

The indoor unit 3*a* mainly includes an indoor expansion valve 51*a* and an indoor heat exchanger 52*a*. The indoor unit 3*a* further includes an indoor liquid-refrigerant pipe 53*a*, which connects the liquid-side end of the indoor heat exchanger 52*a* and the liquid-refrigerant connection pipe 5 (here, the branch pipe portion 5*aa*) to each other, and an indoor gas-refrigerant pipe 54*a*, which connects the gas-side end of the indoor heat exchanger 52*a* and the gas-refrigerant connection pipe 6 (here, the branch pipe portion 6*a*) to each other.

The indoor expansion valve 51*a* is an electric expansion valve capable of adjusting the flow rate of refrigerant that flows through the indoor heat exchanger 52*a* while decompressing the refrigerant. The indoor expansion valve 51*a* is disposed in the indoor liquid-refrigerant pipe 53*a*.

The indoor heat exchanger 52*a* is a heat exchanger that functions as a refrigerant evaporator to cool indoor air or functions as a refrigerant radiator to heat indoor air. The indoor unit 3*a* includes an indoor fan 55*a* for sucking indoor air into the indoor unit 3*a* and supplying the air into an indoor space after the indoor air is subjected to heat exchange with refrigerant by the indoor heat exchanger 52*a*. That is, the indoor unit 3*a* includes the indoor fan 55*a* as a fan that supplies to the indoor heat exchanger 52*a* indoor air serving as a source for cooling or heating refrigerant that flows through the indoor heat exchanger 52*a*. The indoor fan 55*a* is driven by an indoor-fan motor 56*a*.

The indoor unit 3*a* is provided with various sensors. Specifically, the indoor unit 3*a* is provided with an indoor heat-exchange liquid-side sensor 57*a*, which detects the temperature Trl of refrigerant at the liquid-side end of the indoor heat exchanger 52*a*, an indoor heat-exchange gas-side sensor 58*a*, which detects the temperature Trg of refrigerant at the gas-side end of the indoor heat exchanger 52*a*, and an indoor air sensor 59*a*, which detects the temperature Tra of indoor air sucked into the indoor unit 3*a*. The indoor unit 3*a* is also provided with a refrigerant sensor 79*a* as refrigerant leakage detector for detecting leakage of refrigerant. While the refrigerant sensor 79*a* is disposed in the indoor unit 3*a*, this is not limiting. The refrigerant sensor 79*a* may be disposed in a remote control used to operate the indoor unit 3*a*, or may be disposed in an indoor space or the like to be air-conditioned by the indoor unit 3*a*.

<Outdoor Unit>

The outdoor unit 2 is installed in an outside space, such as outside a building. As described above, the outdoor unit 2 is connected to the indoor units 3*a*, 3*b*, 3*c*, and 3*d* via the liquid-refrigerant connection pipe 5, the gas-refrigerant connection pipe 6 (the high/low-pressure gas-refrigerant connection pipe 7, the low-pressure gas-refrigerant connection pipe 8, and the branch pipe portions 6*a*, 6*b*, 6*c*, and 6*d*), and the relay units 4*a*, 4*b*, 4*c*, and 4*d*. The outdoor unit 2 forms part of the refrigerant circuit 10.

The outdoor unit 2 mainly includes the compressor 21 and one or more (here, two) outdoor heat exchangers 23*a* and 23*b*. The outdoor unit 2 further includes switching mechanisms 22*a* and 22*b* for switching between a radiation operation state in which each of the outdoor heat exchangers 23*a* and 23*b* functions as a refrigerant radiator and an evaporation operation state in which each of the outdoor heat exchangers 23*a* and 23*b* functions as a refrigerant evaporator. The switching mechanisms 22*a* and 22*b* and the suction side of the compressor 21 are connected to each other by a suction refrigerant pipe 31. The suction refrigerant pipe 31 is provided with an accumulator 29, which temporarily stores refrigerant to be sucked into the compressor 21. The discharge side of the compressor 21 and the switching mechanisms 22*a* and 22*b* are connected to each other by a discharge refrigerant pipe 32. The switching mechanism 22*a* and 22*b* and the gas-side ends of the outdoor heat exchangers 23*a* and 23*b* are connected to each other by first outdoor gas-refrigerant pipes 33*a* and 33*b*. The liquid-side ends of the outdoor heat exchangers 23*a* and 23*b* and the liquid-refrigerant connection pipe 5 are connected to each other by an outdoor liquid refrigerant pipe 34. A portion of the outdoor liquid refrigerant pipe 34, which is connected to the liquid-refrigerant connection pipe 5, is provided with a liquid-side shutoff valve 27. The outdoor unit 2 further includes a third switching mechanism 22*c* for switching between a refrigerant outflow state in which refrigerant discharged from the compressor 21 is delivered to the high/low-pressure gas-refrigerant connection pipe 7 and a refrigerant inflow state in which refrigerant flowing through the high/low-pressure gas-refrigerant connection pipe 7 is delivered to the suction refrigerant pipe 31. The third switching mechanism 22*c* and the high/low-pressure gas-refrigerant connection pipe 7 are connected to each other by a second outdoor gas-refrigerant pipe 35. The third switching mechanism 22*c* and the suction side of the compressor 21 are connected to each other by the suction refrigerant pipe 31. The discharge side of the compressor 21 and the third switching mechanism 22*c* are connected to each other by the discharge refrigerant pipe 32. A portion of the second outdoor gas-refrigerant pipe 35, which is connected to the high/low-pressure gas-refrigerant connection pipe 7, is provided with a high/low-pressure gas-side shutoff valve 28*a*. The suction refrigerant pipe 31 is connected to the low-pressure gas-refrigerant connection pipe 8. A portion of the suction refrigerant pipe 31, which is connected to the low-pressure gas-refrigerant connection pipe 8, is provided with a low-pressure gas-side shutoff valve 28*b*. The liquid-side shutoff valve 27 and the gas-side shutoff valves 28*a* and 28*b* are manually openable and closable valves.

The compressor 21 is a device for compressing refrigerant. Examples of the compressor 21 include a hermetically sealed compressor in which a positive displacement compression element (not illustrated), such as a rotary or scroll compression element, is driven to rotate by a compressor motor 21*a*.

The first switching mechanism 22*a* is a device capable of switching the flow of refrigerant in the refrigerant circuit 10 such that, when the first outdoor heat exchanger 23*a* is caused to function as a refrigerant radiator (hereinafter referred to as "outdoor radiation state"), the discharge side of the compressor 21 and the gas side of the first outdoor heat exchanger 23*a* are connected to each other (see the solid lines in the first switching mechanism 22*a* in FIG. 1), and, when the first outdoor heat exchanger 23*a* is caused to function as a refrigerant evaporator (hereinafter referred to as "outdoor evaporation state"), the suction side of the compressor 21 and the gas side of the first outdoor heat exchanger 23*a* are connected to each other (see the broken lines in the first switching mechanism 22*a* in FIG. 1). The first switching mechanism 22*a* is constituted by a four-way switching valve, for example. The second switching mechanism 22*b* is a device capable of switching the flow of refrigerant in the refrigerant circuit 10 such that, when the second outdoor heat exchanger 23*b* is caused to function as a refrigerant radiator (hereinafter referred to as "outdoor radiation state"), the discharge side of the compressor 21 and the gas side of the second outdoor heat exchanger 23*b* are connected to each other (see the solid lines in the second switching mechanism 22*b* in FIG. 1), and, when the second outdoor heat exchanger 23*b* is caused to function as a refrigerant evaporator (hereinafter referred to as "outdoor evaporation state"), the suction side of the compressor 21 and the gas side of the second outdoor heat exchanger 23*b* are connected to each other (see the broken lines in the second switching mechanism 22*b* in FIG. 1). The second switching mechanism 22*b* is constituted by a four-way switching valve, for example. Changing the switching states of the switching mechanisms 22*a* and 22*b* enables individual switching of the outdoor heat exchangers 23*a* and 23*b* so that each of the outdoor heat exchangers 23*a* and 23*b* functions as a refrigerant evaporator or a refrigerant radiator.

The first outdoor heat exchanger 23*a* is a heat exchanger that functions as a refrigerant radiator or a refrigerant evaporator. The second outdoor heat exchanger 23*b* is a heat exchanger that functions as a refrigerant radiator or a refrigerant evaporator. The outdoor unit 2 includes an outdoor fan 24 for sucking outdoor air into the outdoor unit 2 and discharging the air to the outside after the outdoor air is subjected to heat exchange with refrigerant by the outdoor heat exchangers 23*a* and 23*b*. That is, the outdoor unit 2 includes the outdoor fan 24 as a fan that supplies to the outdoor heat exchangers 23*a* and 23*b* outdoor air serving as a source for cooling or heating refrigerant that flows through the outdoor heat exchangers 23*a* and 23*b*. The outdoor fan 24 is driven by an outdoor fan motor 24*a*.

The third switching mechanism 22*c* is a device capable of switching the flow of refrigerant in the refrigerant circuit 10 such that, when refrigerant discharged from the compressor 21 is to be delivered to the high/low-pressure gas-refrigerant connection pipe 7 (hereinafter referred to as "refrigerant outflow state"), the discharge side of the compressor 21 and the high/low-pressure gas-refrigerant connection pipe 7 are connected to each other (see the broken lines in the third switching mechanism 22*c* in FIG. 1), and, when refrigerant flowing through the high/low-pressure gas-refrigerant connection pipe 7 is to be delivered to the suction refrigerant pipe 31 (hereinafter referred to as "refrigerant inflow state"), the suction side of the compressor 21 and the high/low-pressure gas-refrigerant connection pipe 7 are connected to each other (see the solid lines in the third switching mechanism 22*c* in FIG. 1). The third switching mechanism 22*c* is constituted by a four-way switching valve, for example.

In the air conditioner 1, when focus is placed on the outdoor heat exchangers 23*a* and 23*b*, the liquid-refrigerant connection pipe 5, the relay units 4*a*, 4*b*, 4*c*, and 4*d*, and the indoor heat exchangers 52*a*, 52*b*, 52*c*, and 52*d*, operations (cooling only operation and cooling main operation) are performed in which refrigerant flows from the outdoor heat exchangers 23*a* and 23*b* to the indoor heat exchangers 52*a*, 52*b*, 52*c*, and 52*d*, which function as refrigerant evaporators, through the liquid-refrigerant connection pipe 5 and the relay units 4*a*, 4*b*, 4*c*, and 4*d*. The cooling only operation is an operation state in which only indoor heat exchangers functioning as refrigerant evaporators (i.e., indoor units that perform cooling operation) exist, and the cooling main operation is an operation state in which both indoor heat exchangers functioning as refrigerant evaporators and indoor heat exchangers functioning as refrigerant radiators (i.e., indoor units that perform heating operation) exist, with the load on the evaporation side (i.e., cooling load) being larger as a whole. In the air conditioner 1, furthermore, when focus is placed on the compressor 21, the gas-refrigerant connection pipe 6, the relay units 4*a*, 4*b*, 4*c*, and 4*d*, and the indoor heat exchangers 52*a*, 52*b*, 52*c*, and 52*d*, operations (heating only operation and heating main operation) are performed in which refrigerant flows from the compressor 21 to the indoor heat exchangers 52*a*, 52*b*, 52*c*, and 52*d*, which function as refrigerant radiators, through the gas-refrigerant connection pipe 6 and the relay units 4*a*, 4*b*, 4*c*, and 4*d*. The heating only operation is an operation state in which only indoor heat exchangers functioning as refrigerant radiators (i.e., indoor units that perform heating operation) exist, and the heating main operation is an operation state in which both indoor heat exchangers functioning as refrigerant radiators and indoor heat exchangers functioning as refrigerant evaporators exist, with the load on the radiation side (i.e., heating load) being larger as a whole. In the cooling only operation and the cooling main operation, at least one of the switching mechanisms 22*a* and 22*b* is switched to the outdoor radiation state. Accordingly, the entirety of the outdoor heat exchangers 23*a* and 23*b* functions as a refrigerant radiator, and refrigerant is caused to flow from the outdoor unit 2 to the indoor units 3*a*, 3*b*, 3*c*, and 3*d* through the liquid-refrigerant connection pipe 5 and the relay units 4*a*, 4*b*, 4*c*, and 4*d*. In the heating only operation and the heating main operation, at least one of the switching mechanisms 22*a* and 22*b* is switched to the outdoor evaporation state, and the third switching mechanism 22*c* is switched to the refrigerant outflow state. Accordingly, the entirety of the outdoor heat exchangers 23*a* and 23*b* functions as a refrigerant evaporator, and refrigerant is caused to flow from the indoor units 3*a*, 3*b*, 3*c*, and 3*d* to the outdoor unit 2 through the liquid-refrigerant connection pipe 5 and the relay units 4*a*, 4*b*, 4*c*, and 4*d*.

Furthermore, the outdoor liquid refrigerant pipe 34 is provided with outdoor expansion valves 25*a* and 25*b*. The outdoor expansion valves 25*a* and 25*b* are each an electric expansion valve that decompresses refrigerant in the heating only operation and the heating main operation. The outdoor expansion valves 25*a* and 25*b* are disposed in portions of the outdoor liquid refrigerant pipe 34 close to the liquid-side ends of the outdoor heat exchangers 23*a* and 23*b*.

Moreover, a refrigerant return pipe 41 is connected to the outdoor liquid refrigerant pipe 34, and the outdoor liquid refrigerant pipe 34 is further provided with a refrigerant cooler 45. The refrigerant return pipe 41 is a refrigerant pipe that delivers a branch portion of refrigerant flowing through the outdoor liquid refrigerant pipe 34 to the compressor 21. The refrigerant cooler 45 is a heat exchanger that cools refrigerant flowing through the outdoor liquid refrigerant pipe 34 by using the refrigerant flowing through the refrigerant return pipe 41. The outdoor expansion valves 25*a* and 25*b* are disposed in portions of the outdoor liquid refrigerant pipe 34 closer to the outdoor heat exchangers 23*a* and 23*b* than to the refrigerant cooler 45.

The refrigerant return pipe 41 is a refrigerant pipe that branches off from the outdoor liquid refrigerant pipe 34 and that delivers refrigerant to the suction side of the compressor 21. The refrigerant return pipe 41 mainly includes a refrigerant return inlet pipe 42 and a refrigerant return outlet pipe 43. The refrigerant return inlet pipe 42 is a refrigerant pipe that delivers a branch portion of refrigerant flowing through the outdoor liquid refrigerant pipe 34 from a portion between the liquid-side ends of the outdoor heat exchangers 23*a* and 23*b* and the liquid-side shutoff valve 27 (here, from a portion between the outdoor expansion valves 25*a* and 25*b* and the refrigerant cooler 45) to the inlet of the refrigerant cooler 45 on the refrigerant return pipe 41 side. The refrigerant return inlet pipe 42 is provided with a refrigerant return expansion valve 44, which adjusts the flow rate of refrigerant that flows through the refrigerant cooler 45 while decompressing the refrigerant flowing through the refrigerant return pipe 41. The refrigerant return expansion valve 44 is constituted by an electric expansion valve. The refrigerant return outlet pipe 43 is a refrigerant pipe that delivers refrigerant from the outlet of the refrigerant cooler 45 on the refrigerant return pipe 41 side to the suction refrigerant pipe 31. In addition, the refrigerant return outlet pipe 43 of the refrigerant return pipe 41 is connected to a portion of the suction refrigerant pipe 31, which corresponds to the inlet of the accumulator 29. The refrigerant cooler 45 is configured to cool refrigerant flowing through the outdoor liquid refrigerant pipe 34 by using the refrigerant flowing through the refrigerant return pipe 41.

The outdoor unit 2 is provided with various sensors. Specifically, the outdoor unit 2 is provided with a discharge pressure sensor 36, which detects the pressure (discharge pressure Pd) of refrigerant discharged from the compressor 21, a discharge temperature sensor 37, which detects the temperature (discharge temperature Td) of refrigerant discharged from the compressor 21, and a suction pressure sensor 39, which detects the pressure (suction pressure Ps) of refrigerant to be sucked into the compressor 21. The outdoor unit 2 is further provided with outdoor heat-exchange liquid-side sensors 38*a* and 38*b*, which detect the temperatures Tol (outdoor heat-exchange outlet temperatures Tol) of refrigerant at the liquid-side ends of the outdoor heat exchangers 23*a* and 23*b*.

<Relay Unit>

The relay units 4*a*, 4*b*, 4*c*, and 4*d* are installed in indoor spaces, such as in a building. The relay units 4*a*, 4*b*, 4*c*, and 4*d* are interposed, together with the liquid-refrigerant connection pipe 5 and the gas-refrigerant connection pipe 6 (the high/low-pressure gas-refrigerant connection pipe 7, the low-pressure gas-refrigerant connection pipe 8, and the branch pipe portions 6*a*, 6*b*, 6*c*, and 6*d*), between the indoor units 3*a*, 3*b*, 3*c*, and 3*d* and the outdoor unit 2. The relay units 4*a*, 4*b*, 4*c*, and 4*d* form part of the refrigerant circuit 10.

Next, the configuration of the relay units 4*a*, 4*b*, 4*c*, and 4*d* will be described. Since the configuration of the relay unit 4*a* is similar to the configurations of the relay units 4*b*, 4*c*, and 4*d*, only the configuration of the relay unit 4*a* will be described. The configurations of the relay units 4*b*, 4*c*, and 4*d* are respectively denoted by numbers with suffixes "b", "c", and "d", instead of the suffix "a", which is used to indicate the elements of the relay unit 4*a*, and the elements of the relay units 4*b*, 4*c*, and 4*d* will not be described.

The relay unit 4*a* mainly includes a liquid connection pipe 61*a* and a gas connection pipe 62*a*.

The liquid connection pipe 61*a* has an end connected to the first branch pipe portion 5*a* of the liquid-refrigerant connection pipe 5 and another end connected to the second branch pipe portion 5*aa* of the liquid-refrigerant connection pipe 5. The liquid connection pipe 61*a* is provided with a liquid relay shutoff valve 71*a*. The liquid relay shutoff valve 71*a* is an electric expansion valve.

The gas connection pipe 62*a* includes a high-pressure gas connection pipe 63*a*, which is connected to the branch pipe portion 7*a* of the high/low-pressure gas-refrigerant connection pipe 7, a low-pressure gas connection pipe 64*a*, which is connected to the branch pipe portion 8*a* of the low-pressure gas-refrigerant connection pipe 8, and a junction gas connection pipe 65*a* where the high-pressure gas connection pipe 63*a* and the low-pressure gas connection pipe 64*a* are joined together. The junction gas connection pipe 65*a* is connected to the branch pipe portion 6*a* of the gas-refrigerant connection pipe 6. The high-pressure gas connection pipe 63*a* is provided with a high-pressure gas relay shutoff valve 66*a*, and the low-pressure gas connection pipe 64*a* is provided with a low-pressure gas relay shutoff valve 67*a*. The high-pressure gas relay shutoff valve 66*a* and the low-pressure gas relay shutoff valve 67*a* are each constituted by an electric expansion valve.

When the indoor unit 3*a* performs cooling operation, the relay unit 4*a* is capable of functioning to deliver refrigerant, which flows into the liquid connection pipe 61*a* through the first branch pipe portion 5*a* of the liquid-refrigerant connection pipe 5, to the indoor unit 3*a* through the second branch pipe portion 5*aa* of the liquid-refrigerant connection pipe 5, with the liquid relay shutoff valve 71*a* and the low-pressure gas relay shutoff valve 67*a* open; and thereafter return refrigerant, which has been evaporated by heat exchange with indoor air in the indoor heat exchanger 52*a*, to the branch pipe portion 8*a* of the low-pressure gas-refrigerant connection pipe 8 through the branch pipe portion 6*a* of the gas-refrigerant connection pipe 6, the junction gas connection pipe 65*a*, and the low-pressure gas connection pipe 64*a*. When the indoor unit 3*a* performs heating operation, the relay unit 4*a* is capable of functioning to deliver refrigerant, which flows into the high-pressure gas connection pipe 63*a* and the junction gas connection pipe 65*a* through the branch pipe portion 7*a* of the high/low-pressure gas-refrigerant connection pipe 7, to the indoor unit 3*a* through the branch pipe portion 6*a* of the gas-refrigerant connection pipe 6, with the low-pressure gas relay shutoff valve 67*a* closed and the liquid relay shutoff valve 71*a* and the high-pressure gas relay shutoff valve 66*a* open; and thereafter return refrigerant, which has released heat by heat exchange with indoor air in the indoor heat exchanger 52*a*, to the first branch pipe portion 5*a* of the liquid-refrigerant connection pipe 5 through the second branch pipe portion 5*aa* of the liquid-refrigerant connection pipe 5 and the liquid connection pipe 61*a*. In this way, the high-pressure gas relay shutoff valve 66*a* and the low-pressure gas relay shutoff valve 67*a* are configured to be opened and closed in the case of switching the indoor heat exchanger 52*a* so that the indoor heat exchanger 52*a* functions as a refrigerant evaporator or a refrigerant radiator. The relay units 4*b*, 4*c*, and 4*d*, as well as the relay unit 4*a*, also have the functions described above. Thus, the relay units 4*a*, 4*b*, 4*c*, and 4*d* are capable of individually switching the indoor heat exchangers 52*a*, 52*b*, 52*c*, and 52*d* so that each of the indoor heat exchangers 52*a*, 52*b*, 52*c*, and 52*d* functions as a refrigerant evaporator or a refrigerant radiator.

<Controller>

The controller 19 is connected to controllers or the like (not illustrated) included in the outdoor unit 2, the indoor units 3*a*, 3*b*, 3*c*, and 3*d*, and the relay units 4*a*, 4*b*, 4*c*, and 4*d* via transmission links. In FIG. 1, the controller 19 is illustrated at a position away from the outdoor unit 2, the indoor units 3*a*, 3*b*, 3*c*, and 3*d*, and the relay units 4*a*, 4*b*, 4*c*, and 4*d*, for convenience of illustration. The controller 19 controls the components 21, 22*a* to 22*c*, 24, 25*a*, 25*b*, 44, 51*a* to 51*d*, 55*a* to 55*d*, 66*a* to 66*d*, 67*a* to 67*d*, and 71*a* to 71 *d* of the air conditioner 1 (here, the outdoor unit 2, the indoor units 3*a*, 3*b*, 3*c*, and 3*d*, and the relay units 4*a*, 4*b*, 4*c*, and 4*d*), that is, controls the overall operation of the air conditioner 1, in accordance with detection signals and the like of the sensors 36, 37, 38*a*, 38*b*, 39, 57*a* to 57*d*, 58*a* to 58*d*, 59*a* to 59*d*, and 79*a* to 79*d* described above.

(2) Basic Operations of Air Conditioner

Next, the basic operations of the air conditioner 1 will be described with reference to FIG. 1. As described above, the basic operations of the air conditioner 1 include a cooling only operation, a heating only operation, a cooling main operation, and a heating main operation. The basic operations of the air conditioner 1 described below are performed by the controller 19, which controls the components of the air conditioner 1 (the outdoor unit 2, the indoor units 3*a*, 3*b*, 3*c*, and 3*d*, and the relay units 4*a*, 4*b*, 4*c*, and 4*d*).

<Cooling Only Operation>

In the cooling only operation, for example, when all the indoor units 3*a*, 3*b*, 3*c*, and 3*d* perform cooling operation (i.e., an operation in which all the indoor heat exchangers 52*a*, 52*b*, 52*c*, and 52*d* function as refrigerant evaporators and the outdoor heat exchangers 23*a* and 23*b* function as refrigerant radiators), the switching mechanisms 22*a* and 22*b* are switched to the outdoor radiation state (the state indicated by solid lines in the switching mechanisms 22*a* and 22*b* in FIG. 1), and the compressor 21, the outdoor fan 24, and the indoor fans 55*a*, 55*b*, 55*c*, and 55*d* are driven. Further, the third switching mechanism 22*c* is switched to the refrigerant inflow state (the state indicated by solid lines in the switching mechanism 22*c* in FIG. 1), and the liquid relay shutoff valves 71*a*, 71*b*, 71*c*, and 71*d*, the high-pressure gas relay shutoff valves 66*a*, 66*b*, 66*c*, and 66*d*, and the low-pressure gas relay shutoff valves 67*a*, 67*b*, 67*c*, and 67*d* in the relay units 4*a*, 4*b*, 4*c*, and 4*d* are opened.

Then, high-pressure refrigerant discharged from the compressor 21 is delivered to the outdoor heat exchangers 23*a* and 23*b* through the switching mechanisms 22*a* and 22*b*. The refrigerant delivered to the outdoor heat exchangers 23*a* and 23*b* is cooled in the outdoor heat exchangers 23*a* and 23*b*, which function as refrigerant radiators, by heat exchange with outdoor air supplied by the outdoor fan 24 and is thus condensed. The refrigerant flows out of the outdoor unit 2 through the outdoor expansion valves 25*a* and 25*b*, the refrigerant cooler 45, and the liquid-side shutoff valve 27. In this case, in the refrigerant cooler 45, the refrigerant that flows out of the outdoor unit 2 is cooled by using the refrigerant flowing through the refrigerant return pipe 41.

The refrigerant that has flowed out of the outdoor unit 2 are branched into flows which are then delivered to the relay units 4*a*, 4*b*, 4*c*, and 4*d* through the liquid-refrigerant connection pipe 5 (the junction pipe portion and the first branch pipe portions 5*a*, 5*b*, 5*c*, and 5*d*). The flows of refrigerant delivered to the relay units 4*a*, 4*b*, 4*c*, and 4*d* exit the relay units 4*a*, 4*b*, 4*c*, and 4*d* through the liquid relay shutoff valves 71*a*, 71*b*, 71*c*, and 71*d*.

The flows of refrigerant that have exited the relay units 4*a*, 4*b*, 4*c*, and 4*d* are delivered to the indoor units 3*a*, 3*b*, 3*c*, and 3*d* through the second branch pipe portions 5*aa*, 5*bb*, 5*cc*, and 5*dd* (portions of the liquid-refrigerant connection pipe 5 that connect the relay units 4*a*, 4*b*, 4*c*, and 4*d* and the indoor units 3*a*, 3*b*, 3*c*, and 3*d* to each other). The flows of refrigerant delivered to the indoor units 3*a*, 3*b*, 3*c*, and 3*d* are decompressed by the indoor expansion valves 51*a*, 51*b*, 51*c*, and 51*d* and are then delivered to the indoor heat exchangers 52*a*, 52*b*, 52*c*, and 52*d*. The flows of refrigerant delivered to the indoor heat exchangers 52*a*, 52*b*, 52*c*, and 52*d* are heated in the indoor heat exchangers 52*a*, 52*b*, 52*c*, and 52*d*, which function as refrigerant evaporators, by heat exchange with indoor air supplied from indoor spaces by the indoor fans 55*a*, 55*b*, 55*c*, and 55*d*, and are thus evaporated. The flows of refrigerant exit the indoor units 3*a*, 3*b*, 3*c*, and 3*d*. On the other hand, the indoor air cooled in the indoor heat exchangers 52*a*, 52*b*, 52*c*, and 52*d* is delivered to the indoor spaces, thereby cooling the indoor spaces.

The flows of refrigerant that have exited the indoor units 3*a*, 3*b*, 3*c*, and 3*d* are delivered to the relay units 4*a*, 4*b*, 4*c*, and 4*d* through the branch pipe portions 6*a*, 6*b*, 6*c*, and 6*d* of the gas-refrigerant connection pipe 6. The flows of refrigerant delivered to the relay units 4*a*, 4*b*, 4*c*, and 4*d* exit the relay units 4*a*, 4*b*, 4*c*, and 4*d* through the high-pressure gas relay shutoff valves 66*a*, 66*b*, 66*c*, and 66*d* and the low-pressure gas relay shutoff valves 67*a*, 67*b*, 67*c*, and 67*d*.

The flows of refrigerant that have exited the relay units 4*a*, 4*b*, 4*c*, and 4*d* are joined together and are delivered to the outdoor unit 2 through the high/low-pressure gas-refrigerant connection pipe 7 (the junction pipe portion and the branch pipe portions 7*a*, 7*b*, 7*c*, and 7*d*) and the low-pressure gas-refrigerant connection pipe 8 (the junction pipe portion and the branch pipe portions 8*a*, 8*b*, 8*c*, and 8*d*). The refrigerant delivered to the outdoor unit 2 is sucked into the compressor 21 through the gas-side shutoff valves 28*a* and 28*b*, the third switching mechanism 22*c* and the accumulator 29.

<Heating Only Operation>

In the heating only operation, for example, when all the indoor units 3*a*, 3*b*, 3*c*, and 3*d* perform heating operation (i.e., an operation in which all the indoor heat exchangers 52*a*, 52*b*, 52*c*, and 52*d* function as refrigerant radiators and the outdoor heat exchangers 23*a* and 23*b* function as refrigerant evaporators), the switching mechanisms 22*a* and 22*b* are switched to the outdoor evaporation state (the state indicated by broken lines in the switching mechanisms 22*a* and 22*b* in FIG. 1), and the compressor 21, the outdoor fan 24, and the indoor fans 55*a*, 55*b*, 55*c*, and 55*d* are driven. Further, the third switching mechanism 22*c* is switched to the refrigerant outflow state (the state indicated by broken lines in the switching mechanism 22*c* in FIG. 1), the liquid relay shutoff valves 71*a*, 71*b*, 71*c*, and 71*d* and the high-pressure gas relay shutoff valves 66*a*, 66*b*, 66*c*, and 66*d* in the relay units 4*a*, 4*b*, 4*c*, and 4*d* are opened, and the low-pressure gas relay shutoff valves 67*a*, 67*b*, 67*c*, and 67*d* in the relay units 4*a*, 4*b*, 4*c*, and 4*d* are closed.

Then, high-pressure refrigerant discharged from the compressor 21 flows out of the outdoor unit 2 through the third switching mechanism 22*c* and the gas-side shutoff valve 28*a*.

The refrigerant that has flowed out of the outdoor unit 2 branches into flows which are then delivered to the relay units 4*a*, 4*b*, 4*c*, and 4*d* through the gas-refrigerant connection pipe 6 (the junction pipe portion and the branch pipe portions 7*a*, 7*b*, 7*c*, and 7*d* of the high/low-pressure gas-refrigerant connection pipe 7). The flows of refrigerant delivered to the relay units 4*a*, 4*b*, 4*c*, and 4*d* exit the relay units 4*a*, 4*b*, 4*c*, and 4*d* through the high-pressure gas relay shutoff valves 66*a*, 66*b*, 66*c*, and 66*d*.

The flows of refrigerant that have exited the relay units 4*a*, 4*b*, 4*c*, and 4*d* are delivered to the indoor units 3*a*, 3*b*, 3*c*, and 3*d* through the branch pipe portions 6*a*, 6*b*, 6*c*, and 6*d* (portions of the gas-refrigerant connection pipe 6 that connect the relay units 4*a*, 4*b*, 4*c*, and 4*d* and the indoor units 3*a*, 3*b*, 3*c*, and 3*d* to each other). The flows of refrigerant delivered to the indoor units 3*a*, 3*b*, 3*c*, and 3*d* are delivered to the indoor heat exchangers 52*a*, 52*b*, 52*c*, and 52*d*. The flows of high-pressure refrigerant delivered to the indoor heat exchangers 52*a*, 52*b*, 52*c*, and 52*d* are cooled in the indoor heat exchangers 52*a*, 52*b*, 52*c*, and 52*d*, which function as refrigerant radiators, by heat exchange with indoor air supplied from indoor spaces by the indoor fans 55*a*, 55*b*, 55*c*, and 55*d*, and are thus condensed. The flows of refrigerant are decompressed by the indoor expansion valves 51*a*, 51*b*, 51*c*, and 51*d* and then exit the indoor units 3*a*, 3*b*, 3*c*, and 3*d*. On the other hand, the indoor air heated in the indoor heat exchangers 52*a*, 52*b*, 52*c*, and 52*d* is delivered to the indoor spaces, thereby heating the indoor spaces.

The flows of refrigerant that have exited the indoor units 3*a*, 3*b*, 3*c*, and 3*d* are delivered to the relay units 4*a*, 4*b*, 4*c*, and 4*d* through the second branch pipe portions 5*aa*, 5*bb*, 5*cc*, and 5*dd* (portions of the liquid-refrigerant connection pipe 5 that connect the relay units 4*a*, 4*b*, 4*c*, and 4*d* and the indoor units 3*a*, 3*b*, 3*c*, and 3*d* to each other). The flows of refrigerant delivered to the relay units 4*a*, 4*b*, 4*c*, and 4*d* exit the relay units 4*a*, 4*b*, 4*c*, and 4*d* through the liquid relay shutoff valves 71*a*, 71*b*, 71*c*, and 71*d*.

The flows of refrigerant that have exited the relay units 4*a*, 4*b*, 4*c*, and 4*d* are joined together and are delivered to the outdoor unit 2 through the liquid-refrigerant connection pipe 5 (the junction pipe portion and the first branch pipe portions 5*a*, 5*b*, 5*c*, and 5*d*). The refrigerant delivered to the outdoor unit 2 is delivered to the outdoor expansion valves 25*a* and 25*b* through the liquid-side shutoff valve 27 and the refrigerant cooler 45. The refrigerant delivered to the outdoor expansion valves 25*a* and 25*b* is decompressed by the outdoor expansion valves 25*a* and 25*b* and is then delivered to the outdoor heat exchangers 23*a* and 23*b*. The refrigerant delivered to the outdoor heat exchangers 23*a* and 23*b* is heated by heat exchange with outdoor air supplied by the outdoor fan 24 and is then evaporated. The refrigerant is sucked into the compressor 21 through the switching mechanisms 22*a* and 22*b* and the accumulator 29.

<Cooling Main Operation>

In the cooling main operation, for example, when the indoor units 3*b*, 3*c*, and 3*d* perform cooling operation and the indoor unit 3*a* performs heating operation (i.e., an operation in which the indoor heat exchangers 52*b*, 52*c*, and 52*d* function as refrigerant evaporators and the indoor heat exchanger 52*a* functions as a refrigerant radiator) and the outdoor heat exchangers 23*a* and 23*b* function as refrigerant radiators, the switching mechanisms 22*a* and 22*b* are switched to the outdoor radiation state (the state indicated by solid lines in the switching mechanisms 22*a* and 22*b* in FIG. 1), and the compressor 21, the outdoor fan 24, and the indoor fans 55*a*, 55*b*, 55*c*, and 55*d* are driven. Further, the third switching mechanism 22*c* is switched to the refrigerant outflow state (the state indicated by broken lines in the switching mechanism 22*c* in FIG. 1), the liquid relay shutoff valve 71*a* and the high-pressure gas relay shutoff valve 66*a* in the relay unit 4*a* and the liquid relay shutoff valves 71*b*, 71*c*, and 71*d* and the low-pressure gas relay shutoff valves 67*b*, 67*c*, and 67*d* in the relay units 4*b*, 4*c*, and 4*d* are opened, and the low-pressure gas relay shutoff valve 67*a* in the relay unit 4*a* and the high-pressure gas relay shutoff valves 66*b*, 66*c*, and 66*d* in the relay units 4*b*, 4*c*, and 4*d* are closed.

Then, portions of high-pressure refrigerant discharged from the compressor 21 are delivered to the outdoor heat exchangers 23*a* and 23*b* through the switching mechanisms 22*a* and 22*b*, and the remaining portion of the high-pressure refrigerant flows out of the outdoor unit 2 through the third switching mechanism 22*c* and the gas-side shutoff valve 28*a*. The portions of the refrigerant delivered to the outdoor heat exchangers 23*a* and 23*b* are cooled in the outdoor heat exchangers 23*a* and 23*b*, which function as refrigerant radiators, by heat exchange with outdoor air supplied by the outdoor fan 24, and are thus condensed. The portions of the refrigerant flow out of the outdoor unit 2 through the outdoor expansion valves 25*a* and 25*b*, the refrigerant cooler 45, and the liquid-side shutoff valve 27. In this case, in the refrigerant cooler 45, the refrigerant that flows out of the outdoor unit 2 is cooled by using the refrigerant flowing through the refrigerant return pipe 41.

The refrigerant that has flowed out of the outdoor unit 2 through the third switching mechanism 22*c* and so on is delivered to the relay unit 4*a* through the gas-refrigerant connection pipe 6 (the junction pipe portion and the branch pipe portion 7*a* of the high/low-pressure gas-refrigerant connection pipe 7). The refrigerant delivered to the relay unit 4*a* flows out of the relay unit 4*a* through the high-pressure gas relay shutoff valve 66*a*.

The refrigerant that has flowed out of the relay unit 4*a* is delivered to the indoor unit 3*a* through the branch pipe portion 6*a* (a portion of the gas-refrigerant connection pipe 6 that connects the relay unit 4*a* and the indoor unit 3*a* to each other). The refrigerant delivered to the indoor unit 3*a* is delivered to the indoor heat exchanger 52*a*. The high-pressure refrigerant delivered to the indoor heat exchanger 52*a* is cooled in the indoor heat exchanger 52*a*, which functions as a refrigerant radiator, by heat exchange with indoor air supplied from an indoor space by the indoor fan 55*a*, and is thus condensed. The refrigerant is decompressed by the indoor expansion valve 51*a* and then flows out of the indoor unit 3*a*. On the other hand, the indoor air heated in the indoor heat exchanger 52*a* is delivered to the indoor space, thereby heating the indoor space.

The refrigerant that has flowed out of the indoor unit 3*a* is delivered to the relay unit 4*a* through the second branch pipe portion 5*aa* (a portion of the liquid-refrigerant connection pipe 5 that connects the relay unit 4*a* and the indoor unit 3*a* to each other). The refrigerant delivered to the relay unit 4*a* flows out of the relay unit 4*a* through the liquid relay shutoff valve 71*a*.

The refrigerant that has flowed out of the relay unit 4*a* is delivered to the junction pipe portion of the liquid-refrigerant connection pipe 5 through the first branch pipe portion 5*a* and is joined with the flows of refrigerant that have exited the outdoor unit 2 through the outdoor heat exchangers 23*a* and 23*b* and so on. The refrigerant branches into flows which are then delivered to the relay units 4*b*, 4*c*, and 4*d* through the first branch pipe portions 5*b*, 5*c*, and 5*d* of the liquid-refrigerant connection pipe 5. The flows of refrigerant delivered to the relay units 4*b*, 4*c*, and 4*d* exit the relay units 4*b*, 4*c*, and 4*d* through the liquid relay shutoff valves 71*b*, 71*c*, and 71*d*.

The flows of refrigerant that have exited the relay units 4*b*, 4*c*, and 4*d* are delivered to the indoor units 3*b*, 3*c*, and 3*d* through the second branch pipe portions 5*bb*, 5*cc*, and 5*dd* (portions of the liquid-refrigerant connection pipe 5 that connect the relay units 4*b*, 4*c*, and 4*d* and the indoor units 3*b*, 3*c*, and 3*d* to each other). The flows of refrigerant delivered to the indoor units 3*b*, 3*c*, and 3*d* are decompressed by the indoor expansion valves 51*b*, 51*c*, and 51*d* and are then delivered to the indoor heat exchangers 52*b*, 52*a*, and 52*b*. The flows of refrigerant delivered to the indoor heat exchangers 52*b*, 52*c*, and 52*d* are heated in the indoor heat exchangers 52*b*, 52*c*, and 52*d*, which function as refrigerant evaporators, by heat exchange with indoor air supplied from indoor spaces by the indoor fans 55*b*, 55*c*, and 55*d*, and are thus evaporated. The flows of refrigerant exit the indoor units 3*b*, 3*c*, and 3*d*. On the other hand, the indoor air cooled in the indoor heat exchangers 52*b*, 52*c*, and 52*d* is delivered to the indoor spaces, thereby cooling the indoor spaces.

The flows of refrigerant that have exited the indoor units 3*b*, 3*c*, and 3*d* are delivered to the relay units 4*b*, 4*c*, and 4*d* through the branch pipe portions 6*b*, 6*c*, and 6*d* of the gas-refrigerant connection pipe 6. The flows of refrigerant delivered to the relay units 4*b*, 4*c*, and 4*d* exit the relay units 4*b*, 4*c*, and 4*d* through the low-pressure gas relay shutoff valves 67*b*, 67*c*, and 67*d*.

The flows of refrigerant that have exited the relay units 4*b*, 4*c*, and 4*d* are joined together and are delivered to the outdoor unit 2 through the low-pressure gas-refrigerant connection pipe 8 (the junction pipe portion and the branch pipe portions 8*b*, 8*c*, and 8*d*). The refrigerant delivered to the outdoor unit 2 is sucked into the compressor 21 through the gas-side shutoff valve 28*b*, the third switching mechanism 22*c*, and the accumulator 29.

<Heating Main Operation>

In the heating main operation, for example, when the indoor units 3*b*, 3*c*, and 3*d* perform heating operation and the indoor unit 3*a* performs cooling operation (i.e., an operation in which the indoor heat exchangers 52*b*, 52*c*, and 52*d* function as refrigerant radiators and the indoor heat exchanger 52*a* functions as a refrigerant evaporator) and the outdoor heat exchangers 23*a* and 23*b* function as refrigerant evaporators, the switching mechanisms 22*a* and 22*b* are switched to the outdoor evaporation state (the state indicated by broken lines in the switching mechanisms 22*a* and 22*b* in FIG. 1), and the compressor 21, the outdoor fan 24, and the indoor fans 55*a*, 55*b*, 55*c*, and 55*d* are driven. Further, the third switching mechanism 22*c* is switched to the refrigerant outflow state (the state indicated by broken lines in the switching mechanism 22*c* in FIG. 1), the high-pressure gas relay shutoff valve 66*a* in the relay unit 4*a* and the low-pressure gas relay shutoff valves 67*b*, 67*c*, and 67*d* in the relay units 4*b*, 4*c*, and 4*d* are closed, and the liquid relay shutoff valve 71*a* and the low-pressure gas relay shutoff valve 67*a* in the relay unit 4*a* and the liquid relay shutoff valves 71*b*, 71*c*, and 71*d* and the high-pressure gas relay shutoff valves 66*b*, 66*c*, and 66*d* in the relay units 4*b*, 4*c*, and 4*d* are opened.

Then, high-pressure refrigerant discharged from the compressor 21 flows out of the outdoor unit 2 through the third switching mechanism 22*c* and the gas-side shutoff valve 28*a*.

The refrigerant that has flowed out of the outdoor unit 2 branches into flows which are then delivered to the relay units 4*b*, 4*c*, and 4*d* through the gas-refrigerant connection pipe 6 (the junction pipe portion and the branch pipe portions 7*b*, 7*c*, and 7*d* of the high/low-pressure gas-refrigerant connection pipe 7). The flows of refrigerant delivered to the relay units 4*b*, 4*c*, and 4*d* exit the relay units 4*b*, 4*c*, and 4*d* through the high-pressure gas relay shutoff valves 66*b*, 66*c*, and 66*d*.

The flows of refrigerant that have exited the relay units 4*b*, 4*c*, and 4*d* are delivered to the indoor units 3*b*, 3*c*, and 3*d* through the branch pipe portions 6*b*, 6*c*, and 6*d* (portions of the gas-refrigerant connection pipe 6 that connect the relay units 4*b*, 4*c*, and 4*d* and the indoor units 3*b*, 3*c*, and 3*d* to each other). The flows of refrigerant delivered to the indoor units 3*b*, 3*c*, and 3*d* are delivered to the indoor heat exchangers 52*b*, 52*c*, and 52*d*. The flows of high-pressure refrigerant delivered to the indoor heat exchangers 52*b*, 52*c*, and 52*d* are cooled in the indoor heat exchangers 52*b*, 52*c*, and 52*d*, which function as refrigerant radiators, by heat exchange with indoor air supplied from indoor spaces by the indoor fans 55*b*, 55*c*, and 55*d*, and are thus condensed. The flows of refrigerant are decompressed by the indoor expansion valves 51*b*, 51*c*, and 51*d* and then exit the indoor units 3*b*, 3*c*, and 3*d*. On the other hand, the indoor air heated in the indoor heat exchangers 52*b*, 52*c*, and 52*d* is delivered to the indoor spaces, thereby heating the indoor spaces.

The flows of refrigerant that have exited the indoor units 3*b*, 3*c*, and 3*d* are delivered to the relay units 4*b*, 4*c*, and 4*d* through the second branch pipe portions 5*bb*, 5*cc*, and 5*dd* (portions of the liquid-refrigerant connection pipe 5 that connect the relay units 4*b*, 4*c*, and 4*d* and the indoor units 3*b*, 3*c*, and 3*d* to each other). The flows of refrigerant delivered to the relay units 4*b*, 4*c*, and 4*d* exit the relay units 4*b*, 4*c*, and 4*d* through the liquid relay shutoff valves 71*b*, 71*c*, and 71*d*.

The flows of refrigerant that have exited the relay units 4*a*, 4*b*, 4*c*, and 4*d* are joined together in the junction pipe portion through the first branch pipe portions 5*b*, 5*c*, and 5*d* of the liquid-refrigerant connection pipe 5. A portion of the resulting refrigerant is branched and delivered to the relay unit 4*a* through the first branch pipe portion 5*a*, and the remaining portion of the refrigerant is delivered to the outdoor unit 2 through the junction pipe portion of the liquid-refrigerant connection pipe 5.

The refrigerant delivered to the relay unit 4*a* flows out of the relay unit 4*a* through the liquid relay shutoff valve 71*a*.

The refrigerant that has flowed out of the relay unit 4*a* is delivered to the indoor unit 3*a* through the second branch pipe portion 5*aa* (a portion of the liquid-refrigerant connection pipe 5 that connects the relay unit 4*a* and the indoor unit 3*a* to each other). The refrigerant delivered to the indoor unit 3*a* is decompressed by the indoor expansion valve 51*a* and is then delivered to the indoor heat exchanger 52*a*. The refrigerant delivered to the indoor heat exchanger 52*a* is heated in the indoor heat exchanger 52*a*, which functions as a refrigerant evaporator, by heat exchange with indoor air supplied from an indoor space by the indoor fan 55*a*, and is thus evaporated. The refrigerant flows out of the indoor unit 3*a*. On the other hand, the indoor air cooled in the indoor heat exchanger 52*a* is delivered to the indoor space, thereby cooling the indoor space.

The refrigerant that has flowed out of the indoor unit 3*a* is delivered to the relay unit 4*a* through the branch pipe portion 6*a* of the gas-refrigerant connection pipe 6. The refrigerant delivered to the relay unit 4*a* flows out of the relay unit 4*a* through the low-pressure gas relay shutoff valve 67*a*.

The refrigerant that has flowed out of the relay unit 4*a* is delivered to the outdoor unit 2 through the low-pressure gas-refrigerant connection pipe 8 (the junction pipe portion and the branch pipe portion 8*a*).

The refrigerant delivered to the outdoor unit 2 through the junction pipe portion of the liquid-refrigerant connection pipe 5 is delivered to the outdoor expansion valves 25*a* and 25*b* through the liquid-side shutoff valve 27 and the refrigerant cooler 45. The refrigerant delivered to the outdoor expansion valves 25*a* and 25*b* is decompressed by the outdoor expansion valves 25*a* and 25*b* and is then delivered to the outdoor heat exchangers 23*a* and 23*b*. The refrigerant delivered to the outdoor heat exchangers 23*a* and 23*b* is heated by heat exchange with outdoor air supplied by the outdoor fan 24 and is thus evaporated. The refrigerant flows through the switching mechanisms 22*a* and 22*b* and the accumulator 29 and is joined with the refrigerant delivered to the outdoor unit 2 through the low-pressure gas-refrigerant connection pipe 8. The resulting refrigerant is then sucked into the compressor 21.

(3) Operations and Features of Air Conditioner when Refrigerant Leakage Occurs

Next, the operations and features of the air conditioner 1 when refrigerant leakage occurs will be described with reference to FIG. 1 and FIG. 2. As in the basic operations described above, the operations of the air conditioner 1 when refrigerant leakage occurs, described below, are performed by the controller 19, which controls the components of the air conditioner 1 (the outdoor unit 2, the indoor units 3*a*, 3*b*, 3*c*, and 3*d*, and the relay units 4*a*, 4*b*, 4*c*, and 4*d*).

In the air conditioner 1, as described above, in addition to the refrigerant sensors 79*a*, 79*b*, 79*c*, and 79*d*, which serve as refrigerant leakage detectors, the relay shutoff valves 71*a*, 71*b*, 71*c*, 71*d*, 66*a*, 66*b*, 66*c*, 66*d*, 67*a*, 67*b*, 67*c*, and 67*d* are disposed in the relay units 4*a*, 4*b*, 4*c*, and 4*d*. With the use of these components, when the refrigerant sensors 79*a*, 79*b*, 79*c*, and 79*d* detect leakage of refrigerant, the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* may be closed. That is, when refrigerant leakage occurs, portions between the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* including the indoor units 3*a*, 3*b*, 3*c*, and 3*d* may be separated. Accordingly, the refrigerant leaking portion is limited to the portions between the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* including the indoor units 3*a*, 3*b*, 3*c*, and 3*d*.

However, closing the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* means permitting leakage of refrigerant that exists in the portions between the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* including the indoor units 3*a*, 3*b*, 3*c*, and 3*d*. Thus, closing the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* may not be sufficient in terms of reduction in the amount of leakage.

Figure 2:
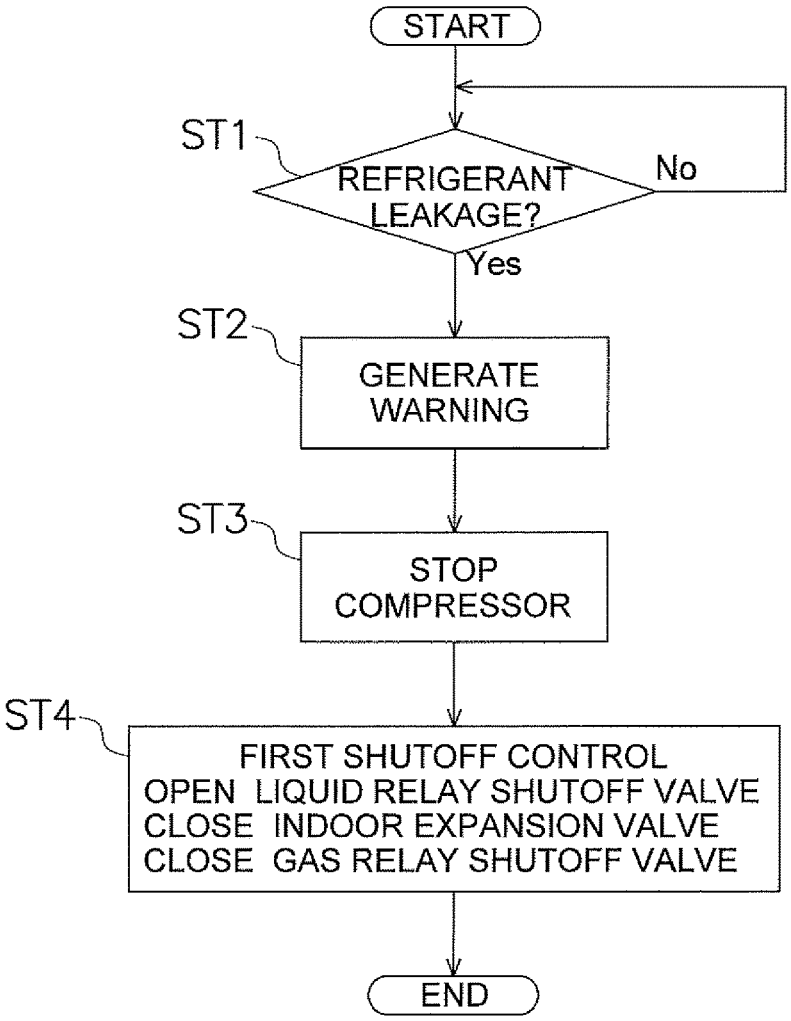
FIG. 2 is a flowchart illustrating an operation of the air conditioner according to the embodiment of the present invention when refrigerant leakage occurs.

To address this, as illustrated in FIG. 2, when the refrigerant sensors 79*a*, 79*b*, 79*c*, and 79*d* detect leakage of refrigerant, that is, when refrigerant leakage occurs (step ST1), the controller 19 performs first shutoff control illustrated in step ST4 on the basis of information from the refrigerant sensors 79*a*, 79*b*, 79*c*, and 79*d*. The first shutoff control is control to open the liquid relay shutoff valves 71*a*, 71*b*, 71*c*, and 71*d* and close the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d*.

As described above, when refrigerant leakage occurs, through the first shutoff control, the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d* are closed with the liquid relay shutoff valves 71*a*, 71*b*, 71*c*, and 71*d* open. Accordingly, only portions between the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d* including the indoor heat exchangers 52*a*, 52*b*, 52*c*, and 52*d*, from which refrigerant is likely to leak, can be separated. Accordingly, the refrigerant leaking portion is limited to the portions between the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d* including the indoor heat exchangers 52*a*, 52*b*, 52*c*, and 52*d*. This means that the refrigerant leaking portion can be made narrower than that in a case where the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* are closed when refrigerant leakage occurs, where allowing the refrigerant leaking portion to include the indoor heat exchangers 52*a*, 52*b*, 52*c*, and 52*d*, from which refrigerant is likely to leak.

In this way, when refrigerant leakage occurs, the first shutoff control is performed, thereby enabling separation of only narrow portions between the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d* including the indoor heat exchangers 52*a*, 52*b*, 52*c*, and 52*d*, from which refrigerant is likely to leak. The amount of leakage of refrigerant can thus be reduced.

In addition, as illustrated in FIG. 2, when leakage of refrigerant is detected in step ST1, the controller 19 generates a warning (step ST2). Before performing the first shutoff control, the controller 19 stops the compressor 21 (step ST3) to suppress an excessive increase in the pressure of refrigerant.

The processing of step ST2 is not limited to the processing prior to the processing of step ST4. The processing of step ST2 may be performed simultaneously with the processing of step ST4, or may be performed after the processing of step ST4 is performed. Also, the processing of step ST3 is not limited to the processing prior to the processing of step ST4. If an increase in the pressure of refrigerant to some extent is acceptable, the processing of step ST3 may be performed simultaneously with the processing of step ST4 or immediately after the processing of step ST4 is performed.

(4) Modification 1

In the operation of the air conditioner 1 according to the embodiment described above when refrigerant leakage occurs (see FIG. 2), the liquid relay shutoff valves 71*a*, 71*b*, 71*c*, and 71*d* are opened during first shutoff control.

In this case, refrigerant leakage is most likely to have occurred from around the indoor heat exchangers 52*a*, 52*b*, 52*c*, and 52*d* (portions between the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d* including the indoor heat exchangers 52*a*, 52*b*, 52*c*, and 52*d*). However, refrigerant leakage may also occur from portions between the liquid relay shutoff valves 71*a*, 71*b*, 71*c*, and 71*d* and the indoor expansion valves 51*a*, 51*b*, 51*c*, and 51*d*, which is less likely to occur. It is thus preferable to expect that, when only the portions between the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d* including the indoor heat exchangers 52*a*, 52*b*, 52*c*, and 52*d* are separated through the first shutoff control, refrigerant leakage may also occur from the portions between the liquid relay shutoff valves 71*a*, 71*b*, 71*c*, and 71*d* and the indoor expansion valves 51*a*, 51*b*, 51*c*, and 51*d*. That is, in the first shutoff control, it is preferable to reduce the flow of refrigerant into the portions between the liquid relay shutoff valves 71*a*, 71*b*, 71*c*, and 71*d* and the indoor expansion valves 51*a*, 51*b*, 51*c*, and 51*d* from the outdoor unit 2 side.

Figure 3:
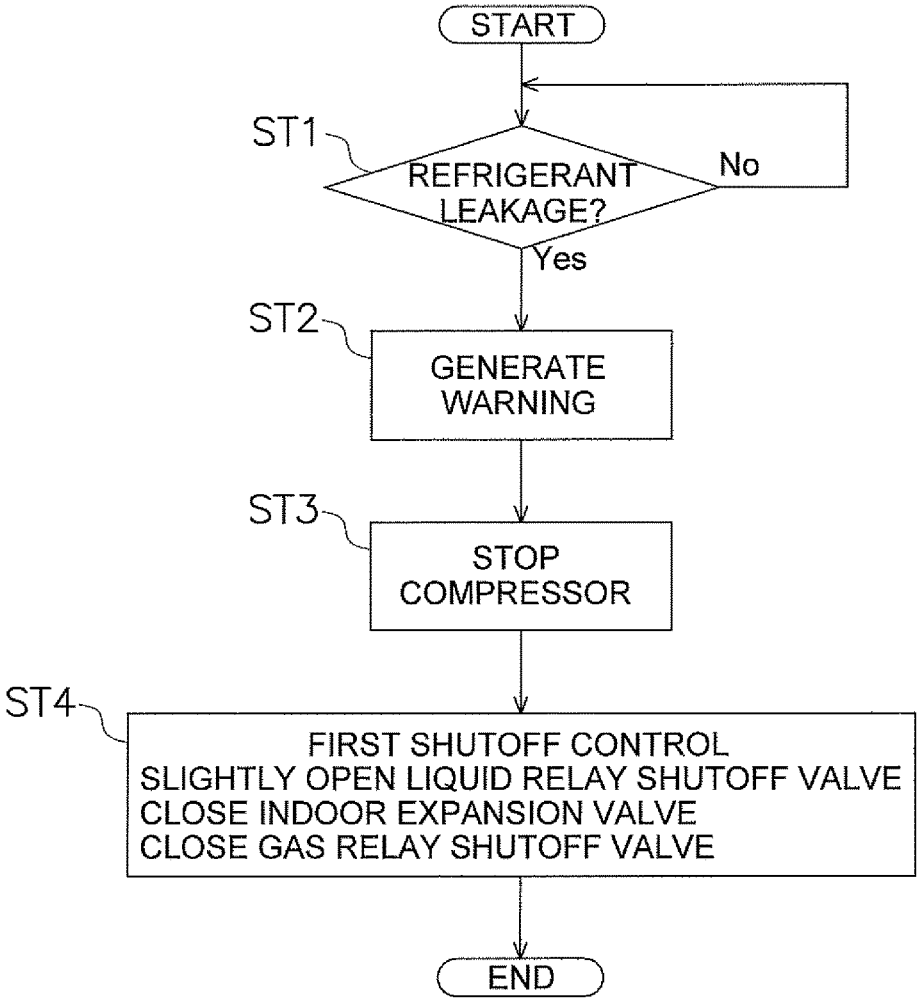
FIG. 3 is a flowchart illustrating an operation of an air conditioner according to Modification 1 of the present invention when refrigerant leakage occurs.

Accordingly, as illustrated in FIG. 3, in the first shutoff control in step ST4, the controller 19 slightly opens the liquid relay shutoff valves 71*a*, 71*b*, 71*c*, and 71*d*, which are constituted by electric expansion valves, to reduce the flow of refrigerant into the portions between the liquid relay shutoff valves 71*a*, 71*b*, 71*c*, and 71*d* and the indoor expansion valves 51*a*, 51*b*, 51*c*, and 51*d* from the outdoor unit 2 side. As used here, the term "slightly opening" refers to opening the liquid relay shutoff valves 71*a*, 71*b*, 71*c*, and 71*d* at an opening degree of about 15% or less when fully opening of the liquid relay shutoff valves 71*a*, 71*b*, 71*c*, and 71*d* is represented as 100%.

Thus, even if leakage of refrigerant has occurred from the portions between the liquid relay shutoff valves 71*a*, 71*b*, 71*c*, and 71*d* and the indoor expansion valves 51*a*, 51*b*, 51*c*, and 51*d*, the leakage of refrigerant from these portions can be minimized during the first shutoff control. It may be possible to fully close the liquid relay shutoff valves 71*a*, 71*b*, 71*c*, and 71*d* in terms of minimization of the leakage of refrigerant. However, fully closing the liquid relay shutoff valves 71*a*, 71*b*, 71*c*, and 71*d* is not preferable because, for example, if the detection of leakage of refrigerant is incorrect, a liquid seal occurs in the portions between the liquid relay shutoff valves 71*a*, 71*b*, 71*c*, and 71*d* and the indoor expansion valves 51*a*, 51*b*, 51*c*, and 51*d*. Slightly opening the liquid relay shutoff valves 71*a*, 71*b*, 71*c*, and 71*d*, in contrast, can suppress the occurrence of a liquid seal in these portions.

(5) Modification 2

In the operation of the air conditioner 1 according to the embodiment and Modification 1 when refrigerant leakage occurs (see FIG. 2 and FIG. 3), only the portions between the indoor expansion valves 51*a*, 51*b*, 51*c*, and 51*d* and the gas relay shutoff valves 66a, 66b, 66c, 66d, 67a, 67b, 67c, and 67d including the indoor heat exchangers 52a, 52b, 52c, and 52d are separated through the first shutoff control.

However, if the leakage of refrigerant continues even after the first shutoff control is performed, leakage of refrigerant may have occurred from the portions between the liquid relay shutoff valves 71a, 71b, 71c, and 71d and the indoor expansion valves 51a, 51b, 51c, and 51d.

Figure 4:
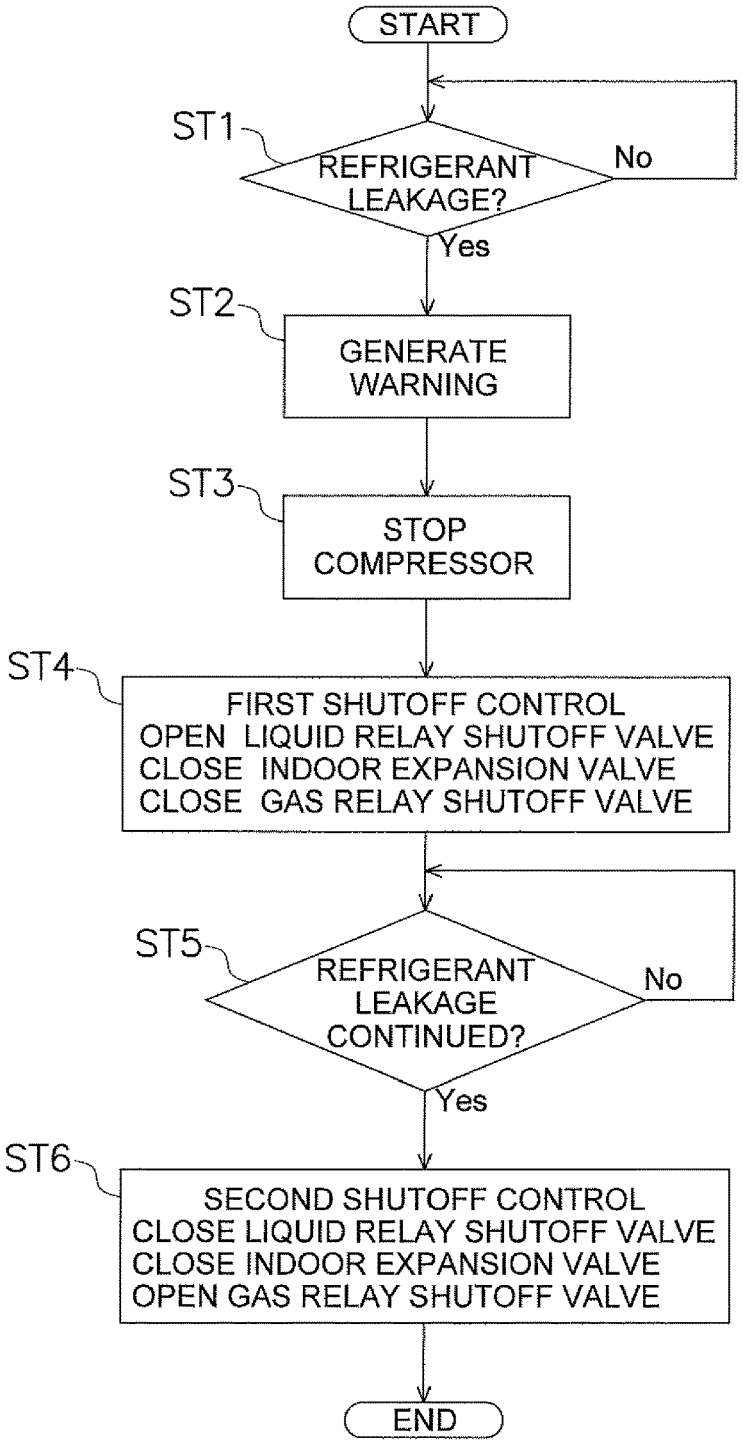
FIG. 4 is a flowchart illustrating an operation of an air conditioner according to Modification 2 of the present invention when refrigerant leakage occurs.
Figure 5:
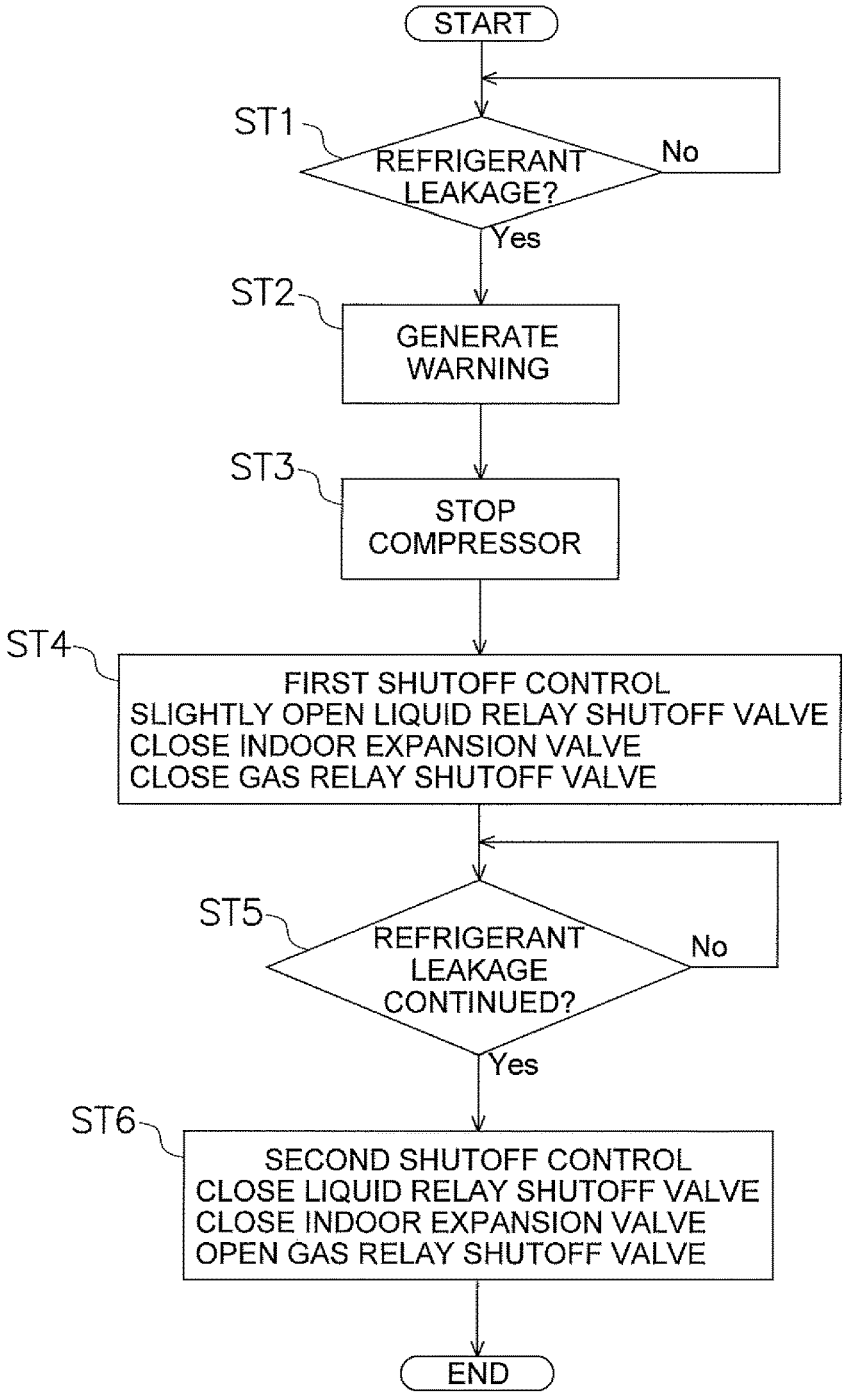
FIG. 5 is a flowchart illustrating an operation of the air conditioner according to Modification 2 of the present invention when refrigerant leakage occurs.

As illustrated in FIG. 4 or FIG. 5, if it is determined that the leakage of refrigerant continues even after the first shutoff control in step ST4 is performed, the controller 19 performs second shutoff control illustrated in step ST6. The second shutoff control is control to close the liquid relay shutoff valves 71a, 71b, 71c, and 71d with the indoor expansion valves 51a, 51b, 51c, and 51d closed, thereby separating the portions between the liquid relay shutoff valves 71a, 71b, 71c, and 71d and the indoor expansion valves 51a, 51b, 51c, and 51d.

Accordingly, when refrigerant leakage occurs, the first shutoff control in step ST4 is followed by the second shutoff control in step ST6, thereby separating the portions between the liquid relay shutoff valves 71a, 71b, 71c, and 71d and the indoor expansion valves 51a, 51b, 51c, and 51d. The amount of leakage of refrigerant can thus be reduced.

Whether the leakage of refrigerant continues even after the first shutoff control in step ST4 is performed is determined by the controller 19 in step ST5. In step ST5, the controller 19 determines whether the leakage of refrigerant continues even after the first shutoff control is performed, on the basis of the temperatures Trl of refrigerant detected by the indoor heat-exchange liquid-side sensors 57a, 57b, 57c, and 57d during the first shutoff control in step ST4. Specifically, the manner in which the temperature Trl of refrigerant tends to change when leakage of refrigerant occurs around the indoor heat exchangers 52a, 52b, 52c, and 52d (in the portions between the indoor expansion valves 51a, 51b, 51c, and 51d and the gas relay shutoff valves 66a, 66b, 66c, 66d, 67a, 67b, 67c, and 67d including the indoor heat exchangers 52a, 52b, 52c, and 52d) is utilized to determine whether the leakage of refrigerant continues. If refrigerant leakage occurs around the indoor heat exchangers 52a, 52b, 52c, and 52d, the temperatures (here, Trl) of refrigerant around the indoor heat exchangers 52a, 52b, 52c, and 52d tend to rapidly change due to refrigerant leakage when, for example, the first shutoff control in step ST4 is performed, compared to the case where no refrigerant leakage occurs around the indoor heat exchangers 52a, 52b, 52c, and 52d. In addition, due to refrigerant leakage, the temperatures (here, Trl) of refrigerant around the indoor heat exchangers 52a, 52b, 52c, and 52d tend to become quickly close to the ambient temperatures of the indoor heat exchangers 52a, 52b, 52c, and 52d (such as the temperatures Tra of indoor air detected by the indoor air sensors 59a, 59b, 59c, and 59d). Accordingly, for example, if the change rates ΔTrl of the temperatures Trl of refrigerant are larger than a predetermined change rate ΔTrls or if the temperatures Trl of refrigerant reach a predetermined temperature Tras, which is determined by the ambient temperature Tra, within a predetermined time period ts, it may be determined that leakage of refrigerant has occurred around the indoor heat exchangers 52a, 52b, 52c, and 52d. On the other hand, if the change rates ΔTrl of the temperatures Trl of refrigerant are less than or equal to the predetermined change rate ΔTrls or if the temperatures Trl of refrigerant do not reach the predetermined temperature Tras, which is determined by the ambient temperature Tra, within the predetermined time period ts, it can be determined that leakage of refrigerant has not occurred around the indoor heat exchangers 52a, 52b, 52c, and 52d, that is, that the leakage of refrigerant continues even after the first shutoff control is performed.

Accordingly, in step ST5, the controller 19 can suitably determine whether the leakage of refrigerant continues even after the first shutoff control is performed.

The temperatures of refrigerant to be used for the determination in step ST5 are not limited to the temperatures Trl of refrigerant detected by the indoor heat-exchange liquid-side sensors 57a, 57b, 57c, and 57d, and the temperatures Trg of refrigerant at the gas-side ends of the indoor heat exchangers 52a, 52b, 52c, and 52d, which are detected by the indoor heat-exchange gas-side sensors 58a, 58b, 58c, and 58d, may be used.

If it is determined in step ST5 that the leakage of refrigerant continues even after the first shutoff control is performed, no leakage of refrigerant is likely to have occurred around the indoor heat exchangers 52a, 52b, 52c, and 52d (in the portions between the indoor expansion valves 51a, 51b, 51c, and 51d and the gas relay shutoff valves 66a, 66b, 66c, 66d, 67a, 67b, 67c, and 67d including the indoor heat exchangers 52a, 52b, 52c, and 52d).

Then, in step ST6, the controller 19 opens the gas relay shutoff valves 66a, 66b, 66c, 66d, 67a, 67b, 67c, and 67d in the second shutoff control.

Accordingly, in step ST6, the separation of the portions between the indoor expansion valves 51a, 51b, 51c, and 51d and the gas relay shutoff valves 66a, 66b, 66c, 66d, 67a, 67b, 67c, and 67d can be canceled, and only the portions between the liquid relay shutoff valves 71a, 71b, 71c, and 71d and the indoor expansion valves 51a, 51b, 51c, and 51d can be separated.

Also in this modification, the processing of step ST2 is not limited to the processing prior to the processing of steps ST4 to ST6. The processing of step ST2 may be performed simultaneously with the processing of any of steps ST4 to ST6, or may be performed after the processing of any of steps ST4 to ST6 is performed. Also, the processing of step ST3 is not limited to the processing prior to the processing of step ST4. If an increase in the pressure of refrigerant to some extent is acceptable, the processing of step ST3 may be performed simultaneously with the processing of step ST4 or immediately after the processing of step ST4 is performed.

(6) Modification 3

In the operation of the air conditioner 1 according to Modification 2 described above when refrigerant leakage occurs (see FIG. 4 and FIG. 5), the gas relay shutoff valves 66a, 66b, 66c, 66d, 67a, 67b, 67c, and 67d are opened in the second shutoff control.

Even if it is determined that the leakage of refrigerant continues even after the first shutoff control is performed, it is difficult to completely deny the probability of occurrence of leakage of refrigerant around the indoor heat exchangers 52a, 52b, 52c, and 52d (in the portions between the indoor expansion valves 51a, 51b, 51c, and 51d and the gas relay shutoff valves 66a, 66b, 66c, 66d, 67a, 67b, 67c, and 67d including the indoor heat exchangers 52a, 52b, 52c, and 52d). It is thus preferable to expect that, when only the portions between the liquid relay shutoff valves 71a, 71b, 71c, and 71d and the indoor expansion valves 51a, 51b, 51c, and 51d are separated through the second shutoff control, refrigerant leakage may also occur from the portions between the indoor expansion valves 51a, 51b, 51c, and 51d and the gas relay shutoff valves 66a, 66b, 66c, 66d, 67a, 67b, 67c, and 67d. That is, in the second shutoff control, it is preferable to reduce the flow of refrigerant into the portions between the gas relay shutoff valves 66*a*, 66*b*, 66*c*, 66*d*, 67*a*, 67*b*, 67*c*, and 67*d* and the indoor expansion valves 51*a*, 51*b*, 51*c*, and 51*d* from the outdoor unit 2 side.

Figure 6:
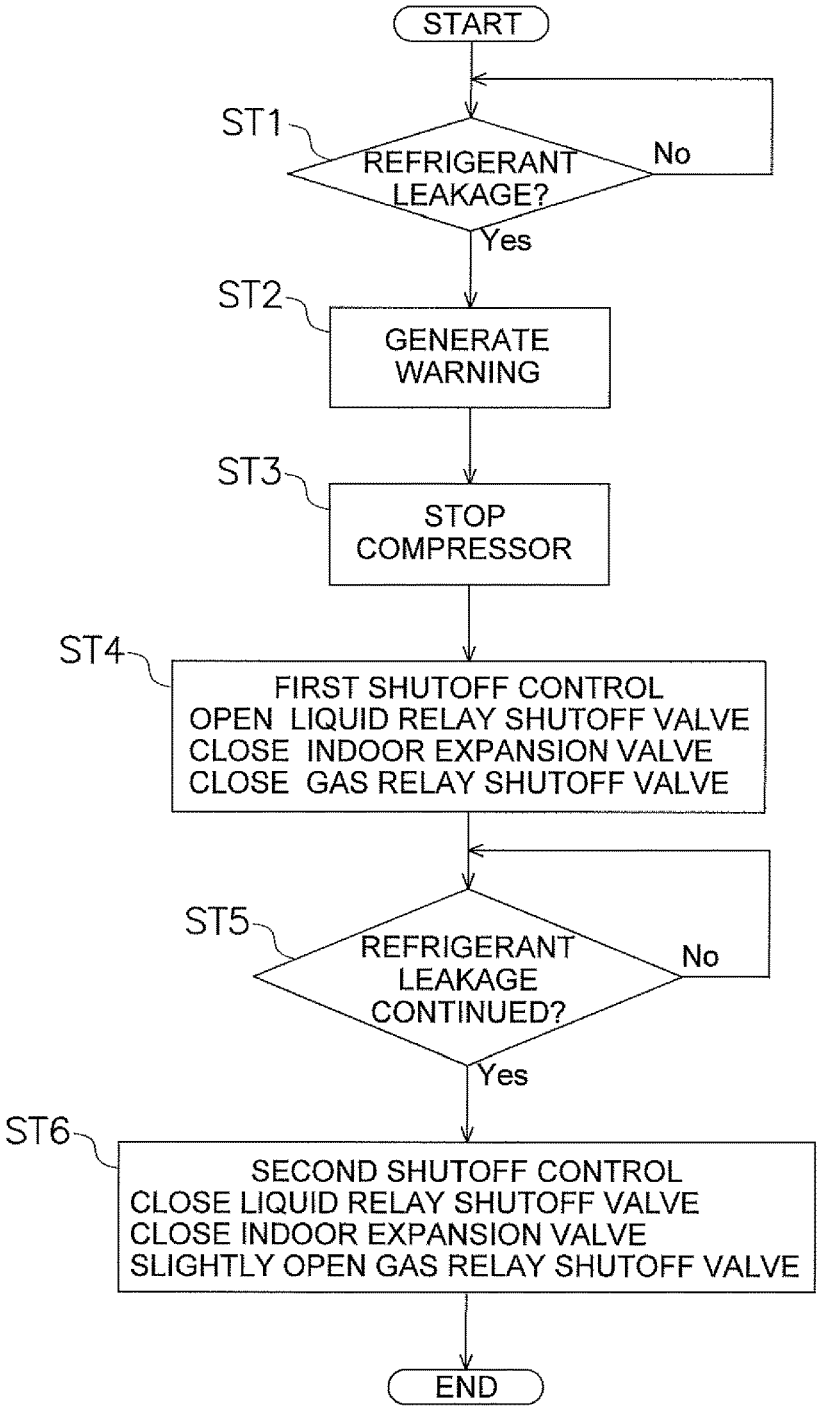
FIG. 6 is a flowchart illustrating an operation of an air conditioner according to Modification 3 of the present invention when refrigerant leakage occurs.
Figure 7:
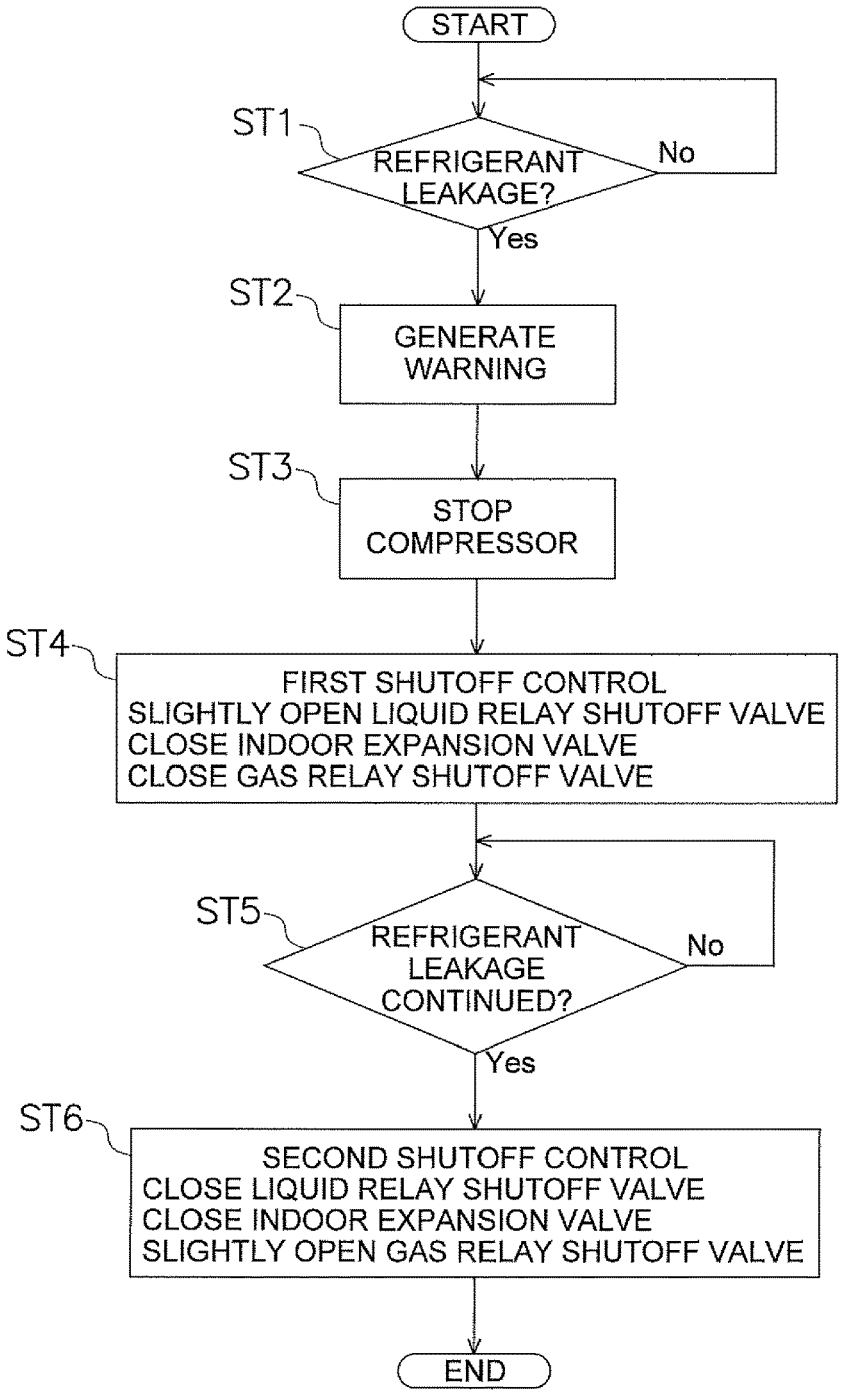
FIG. 7 is a flowchart illustrating an operation of the air conditioner according to Modification 3 of the present invention when refrigerant leakage occurs.

Accordingly, as illustrated in FIG. 6 and FIG. 7, in the second shutoff control in step ST6, the controller 19 slightly opens the gas relay shutoff valves 66*a*, 66*b*, 66*c*, 66*d*, 67*a*, 67*b*, 67*c*, and 67*d*, which are constituted by electric expansion valves, to reduce the flow of refrigerant into the portions between the gas relay shutoff valves 66*a*, 66*b*, 66*c*, 66*d*, 67*a*, 67*b*, 67*c*, and 67*d* and the indoor expansion valves 51*a*, 51*b*, 51*c*, and 51*d* from the outdoor unit 2 side. As used here, the term "slightly opening" refers to opening the gas relay shutoff valves 66*a*, 66*b*, 66*c*, 66*d*, 67*a*, 67*b*, 67*c*, and 67*d* at an opening degree of about 15% or less when fully opening of the gas relay shutoff valves 66*a*, 66*b*, 66*c*, 66*d*, 67*a*, 67*b*, 67*c*, and 67*d* is represented as 100%.

Thus, even if leakage of refrigerant has occurred from the portions between the indoor expansion valves 51*a*, 51*b*, 51*c*, and 51*d* and the gas relay shutoff valves 66*a*, 66*b*, 66*c*, 66*d*, 67*a*, 67*b*, 67*c*, and 67*d*, the leakage of refrigerant from these portions can be minimized during the second shutoff control.

(7) Other Modifications

<A>

The air conditioner 1 according to the above-described embodiment and Modifications 1 to 3 includes the relay units 4*a*, 4*b*, 4*c*, and 4*d* respectively corresponding to the indoor units 3*a*, 3*b*, 3*c*, and 3*d*; however, this is not limiting. For example, all the relay units 4*a*, 4*b*, 4*c*, and 4*d* or some of the relay units 4*a*, 4*b*, 4*c*, and 4*d* may be integrated into a relay unit.

<B>

In the air conditioner 1 according to the above-described embodiment (see FIG. 2) and Modification 2 (see only the case illustrated in FIG. 4), the liquid relay shutoff valves 71*a*, 71*b*, 71*c*, and 71*d* and the gas relay shutoff valves 66*a*, 66*b*, 66*c*, 66*d*, 67*a*, 67*b*, 67*c*, and 67*d* may be openable and closable electromagnetic valves, rather than electric expansion valves. In the air conditioner 1 according to Modification 1 (see FIG. 3) and Modification 2 (see only the case illustrated in FIG. 5), the gas relay shutoff valves 66*a*, 66*b*, 66*c*, 66*d*, 67*a*, 67*b*, 67*c*, and 67*d* may be openable and closable electromagnetic valves, rather than electric expansion valves. In the air conditioner 1 according to Modification 2 (see only the case illustrated in FIG. 6), the liquid relay shutoff valves 71*a*, 71*b*, 71*c*, and 71*d* may be openable and closable electromagnetic valves, rather than electric expansion valves.

<C>

In the basic operations (cooling only operation, heating only operation, cooling main operation, and heating main operation), the air conditioner 1 according to the above-described embodiment and Modifications 1 to 3 controls the respective flow rates of refrigerant flowing through the indoor units 3*a*, 3*b*, 3*c*, and 3*d* through decompression performed by the indoor expansion valves 51*a*, 51*b*, 51*c*, and 51*d*; however, this is not limiting. For example, the liquid relay shutoff valves 71*a*, 71*b*, 71*c*, and 71*d* in the relay units 4*a*, 4*b*, 4*c*, and 4*d*, each of which is an electric expansion valve, may be utilized to control the respective flow rates of refrigerant flowing through the indoor units 3*a*, 3*b*, 3*c*, and 3*d* through decompression performed by the liquid relay shutoff valves 71*a*, 71*b*, 71*c*, and 71*d*, instead of through decompression performed by the indoor expansion valves 51*a*, 51*b*, 51*c*, and 51*d*.

<D>

In the air conditioner 1 according to the above-described embodiment and Modifications 1 to 3, the refrigerant sensors 79*a*, 79*b*, 79*c*, and 79*d* are used as refrigerant leakage detectors for detecting leakage of refrigerant; however, this is not limiting. For example, changes in temperature such as the temperatures Trl or Trg of refrigerant around the indoor heat exchangers 52*a*, 52*b*, 52*c*, and 52*d* or the temperatures Tra of indoor air may be used to detect leakage of refrigerant.

INDUSTRIAL APPLICABILITY

The present invention is widely applicable to air conditioners including an outdoor unit, a plurality of indoor units, a liquid-refrigerant connection pipe, a gas-refrigerant connection pipe, a relay unit including a relay shutoff valve in a liquid connection pipe connected to the liquid-refrigerant connection pipe and a relay shutoff valve in a gas connection pipe connected to the gas-refrigerant connection pipe, and refrigerant leakage detector for detecting leakage of refrigerant.

REFERENCE SIGNS LIST

1 air conditioner
2 outdoor unit
3*a*, 3*b*, 3*c*, 3*d* indoor unit
4*a*, 4*b*, 4*c*, 4*d* relay unit
5 liquid-refrigerant connection pipe
6 gas-refrigerant connection pipe
19 controller
21 compressor
51*a*, 51*b*, 51*c*, 51*d* indoor expansion valve
52*a*, 52*b*, 52*c*, 52*d* indoor heat exchanger
57*a*, 57*b*, 57*c*, 57*d* indoor heat-exchange liquid-side sensor (temperature sensor)
58*a*, 58*b*, 58*c*, 58*d* indoor heat-exchange gas-side sensor (temperature sensor)
61*a*, 61*b*, 61*c*, 61*d* liquid connection pipe
62*a*, 62*b*, 62*c*, 62*d* gas connection pipe
66*a*, 66*b*, 66*c*, 66*d* high-pressure gas relay shutoff valve (gas relay shutoff valve)
67*a*, 67*b*, 67*c*, 67*d* low-pressure gas relay shutoff valve (gas relay shutoff valve)
71*a*, 71*b*, 71*c*, 71*d* liquid relay shutoff valve
79*a*, 79*b*, 79*c*, 79*d* refrigerant sensor (refrigerant leakage detector)

CITATION LIST

Patent Literature

PTL 1: Japanese Patent No. 5517789

The invention claimed is:

1. An air conditioner comprising:

an outdoor unit including a compressor;

a plurality of indoor units (3*a*, 3*b*, 3*c*, 3*d*), each including an indoor expansion valve and an indoor heat exchanger;

a liquid-refrigerant connection pipe and a gas-refrigerant connection pipe that connect the outdoor unit and the indoor units to each other;

at least one relay unit disposed in the liquid-refrigerant connection pipe and the gas-refrigerant connection pipe, the at least one relay unit including a liquid relay shutoff valve in a liquid connection pipe connected to the liquid-refrigerant connection pipe and a gas relay shutoff valve in a gas connection pipe connected to the gas-refrigerant connection pipe, the at least one relay unit being configured to individually switch the plurality of indoor heat exchangers so that each of the plurality of indoor heat exchangers functions as an evaporator for refrigerant or a radiator for the refrigerant;

a refrigerant leakage detector for detecting leakage of the refrigerant; and a controller that controls components of the outdoor unit, the indoor units, and the relay unit, wherein when leakage of the refrigerant occurs, the controller is configured to perform first shutoff control to open the liquid relay shutoff valve and close at least one of the indoor expansion valves and the gas relay shutoff valve on the basis of information from the refrigerant leakage detector.

2. The air conditioner according to claim 1, wherein the liquid relay shutoff valve comprises an electric expansion valve, and the controller slightly opens the liquid relay shutoff valve in the first shutoff control.

3. The air conditioner according to claim 1, wherein when it is determined that the leakage of the refrigerant continues even after the first shutoff control is performed, the controller performs second shutoff control to close the liquid relay shutoff valve with the at least one of the indoor expansion valves closed.

4. The air conditioner according to claim 3, wherein each of the indoor units further includes a temperature sensor that detects a temperature of the refrigerant around the indoor heat exchanger, and the controller determines whether the leakage of the refrigerant continues even after the first shutoff control is performed, on the basis of the temperatures of the refrigerant detected by the temperature sensors during the first shutoff control.

5. The air conditioner according to claim 3, wherein the controller opens the gas relay shutoff valve in the second shutoff control.

6. The air conditioner according to claim 5, wherein the gas relay shutoff valve comprises an electric expansion valve, and the controller slightly opens the gas relay shutoff valve in the second shutoff control.

7. The air conditioner according to claim 2, wherein when it is determined that the leakage of the refrigerant continues even after the first shutoff control is performed, the controller performs second shutoff control to close the liquid relay shutoff valve with the at least one of the indoor expansion valves closed.

8. The air conditioner according to claim 4, wherein the controller opens the gas relay shutoff valve in the second shutoff control.

* * * * *